US008284002B2

(12) United States Patent
Heller et al.

(10) Patent No.: US 8,284,002 B2
(45) Date of Patent: Oct. 9, 2012

(54) VACUUM INTERRUPTER SWITCH FOR POWER DISTRIBUTION SYSTEMS

(75) Inventors: Carl Heller, Brea, CA (US); Kuang-Chien Hu, Xinzhuang (TW)

(73) Assignee: Impact Power, Inc., Irvine, CA (US)

( * ) Notice: Subject to any disclaimer, the term of this patent is extended or adjusted under 35 U.S.C. 154(b) by 106 days.

(21) Appl. No.: 12/865,114

(22) PCT Filed: Feb. 25, 2009

(86) PCT No.: PCT/US2009/035191

§ 371 (c)(1),
(2), (4) Date: Jul. 28, 2010

(87) PCT Pub. No.: WO2009/108729

PCT Pub. Date: Sep. 3, 2009

(65) Prior Publication Data

US 2010/0326960 A1 Dec. 30, 2010

Related U.S. Application Data

(60) Provisional application No. 61/031,154, filed on Feb. 25, 2008.

(51) Int. Cl.
*H01H 9/02* (2006.01)

(52) U.S. Cl. ..... 335/202; 218/140

(58) Field of Classification Search ..... 218/140; 335/202

See application file for complete search history.

(56) References Cited

U.S. PATENT DOCUMENTS

| | | | | |
|---|---|---|---|---|
| 4,440,995 | A * | 4/1984 | Lange et al. | 218/122 |
| 4,663,504 | A * | 5/1987 | Barkan | 218/57 |
| 5,286,933 | A * | 2/1994 | Pham | 218/119 |
| 6,326,872 | B1 * | 12/2001 | Marchand et al. | 335/202 |
| 6,373,358 | B1 * | 4/2002 | Davies et al. | 335/202 |
| 6,541,727 | B2 * | 4/2003 | Beck et al. | 218/140 |
| 7,239,490 | B2 | 7/2007 | Benke | |
| 7,285,743 | B2 | 10/2007 | Martin | |

* cited by examiner

*Primary Examiner* — Truc Nguyen
(74) *Attorney, Agent, or Firm* — Robert A. Seldon

(57) ABSTRACT

A current interrupting switch for power distribution systems comprising an outer case and a plurality of vacuum interrupter bottle switches positioned in the case.

9 Claims, 28 Drawing Sheets

FIG. 18A
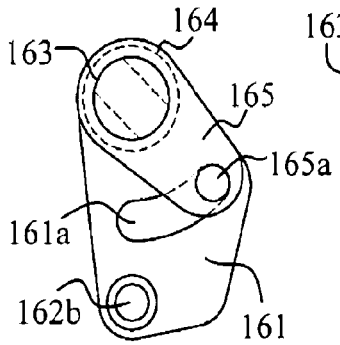
FIG. 18B
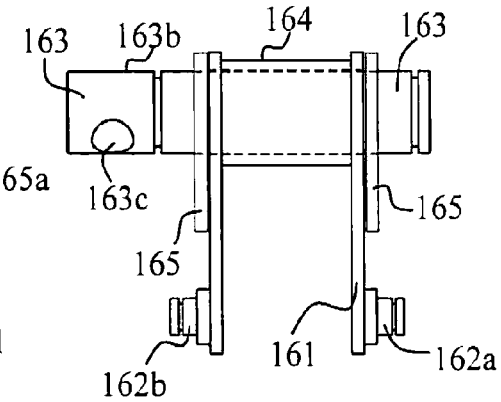
FIG. 18C
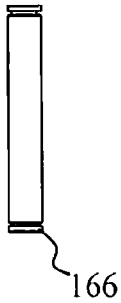
FIG. 18D
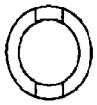
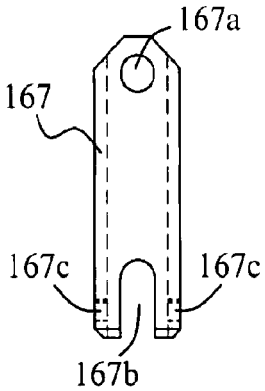
FIG. 18E
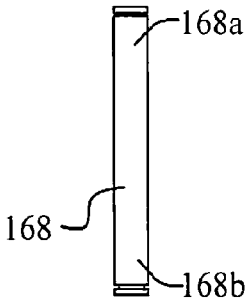
FIG. 18F
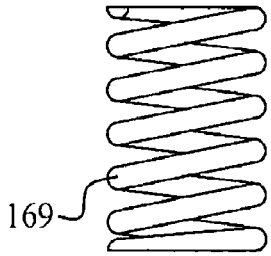
FIG. 18G
FIG. 18H
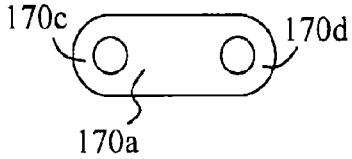
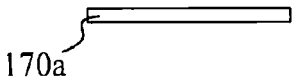
FIG. 18I
FIG. 18J
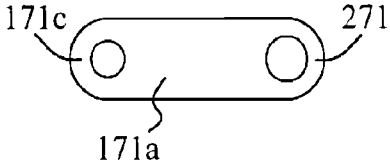
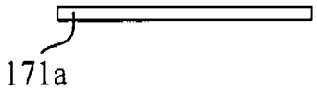
FIG. 18K FIG. 19A
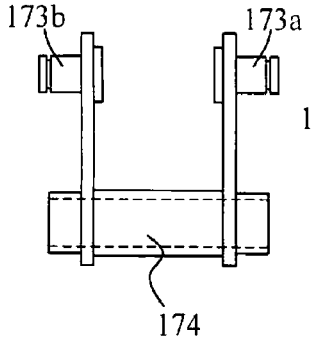
FIG. 19B
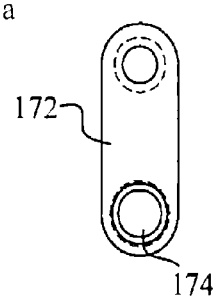
FIG. 19C
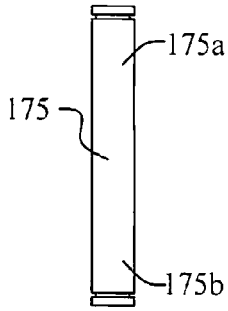
FIG. 19D
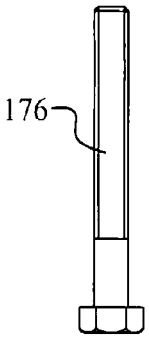
FIG. 19E
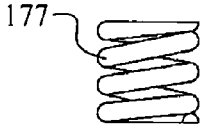
FIG. 19F
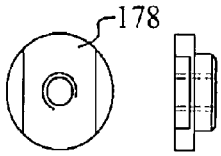
FIG. 19G
FIG. 19H
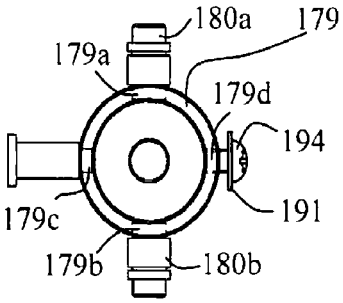
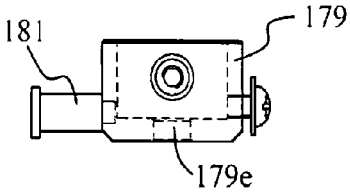
FIG. 19I
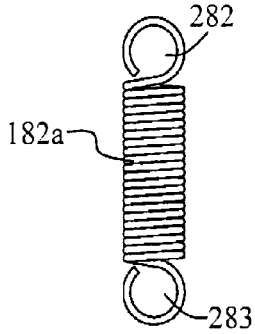
FIG. 19J FIG. 20A
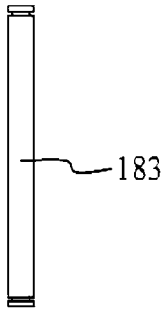
FIG. 20B
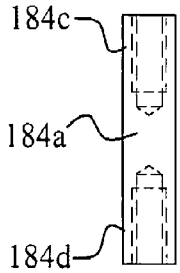
FIG. 20C
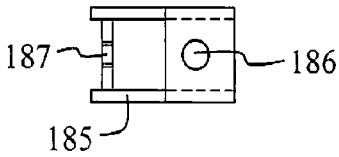
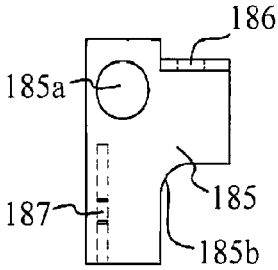
FIG. 20D
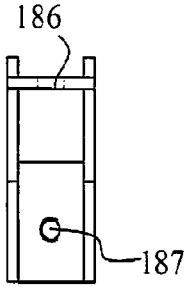
FIG. 20E
FIG. 20F
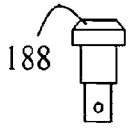
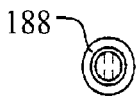
FIG. 20G
FIG. 20H
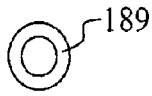
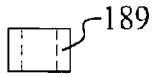
FIG. 20I
FIG. 20J
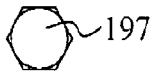
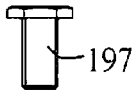
FIG. 20K
FIG. 20L
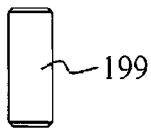
FIG. 20M
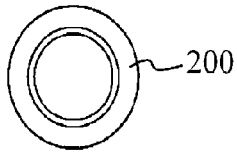
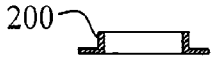
FIG. 20N

VACUUM INTERRUPTER SWITCH FOR POWER DISTRIBUTION SYSTEMS

CROSS REFERENCE TO RELATED APPLICATION

This application claims priority of co-pending U.S. Provisional Patent Application No. 61/031,154, filed Feb. 25, 2008 which is incorporated by reference in its entirety herein and a copy of which is attached hereto as Exhibit A and made a part of this application. To the extent that there may be a conflict between the contents of the text and figures of Exhibit A and the text and figures which are not part of Exhibit A, the contents of the text and figures which are not part of Exhibit A shall govern.

FIELD OF THE INVENTION

The present invention pertains to current interrupting switches for power distribution systems. More particularly, the present invention relates to current interrupting switches for underground locations of power distribution systems.

BACKGROUND

Electric utility power distribution systems are frequently constructed underground for a variety of reasons ranging from objections to the above-ground aesthetics, the premium of above-ground space in dense urban locations, and safety concerns. Accordingly, power distribution systems heretofore constructed of poles, wires, and pole-mounted switches and transformers are being superseded and even replaced by underground systems in underground "vaults".

Space in underground installations is at a premium, and material must be able to fit through municipal access holes, imposing strict dimensional restrictions on any such material. At the same time, environmental and safety concerns have discouraged the use of such dielectric materials as oil and $SF_6$ which can be flammable and/or explosive while presenting environmental problems when leakage occurs or when emissions are created.

"Delta load" centers are located within underground vaults that are as much as a mile or more away from a utility substation. Customers receive power through these delta load centers. Each delta load center is comprised of three single-phase oil switch assemblies which each have four loadbreak switches connected to one another by a common bus. One loadbreak switch is connected to a feeder circuit and the other three are connected to radial branch underground circuits through paper-insulated lead cables (PILCs).

In order to provide power to the designated area, a three-phase feeder cable from the utility substation is brought to the delta load center, divided into three single cables which are each connected to the feeder loadbreak switch of an oil switch assembly. Three radial branch circuits are each connected to a loadbreak switch. Power is served to the customers when they are connected to the radial branch circuits.

The oil switch assemblies currently used in the delta load centers have typically comprised an electrically conductive bayonet-type switch element that is manually pushed in or pulled out between two electrically conductive terminals, one of which is connected to a common bus and the other is connected to the underground circuit. When inserted between the terminals, the bayonet electrically couples the terminals, completing the circuit and energizing the underground circuit. When manually pulled from the terminals, the switch breaks load current, "opens" the circuit, and de-energizes the underground circuit. The terminals and switch element are enclosed in a container that is oil filled.

The present invention pertains to current interrupter switches designed to replace oil switch assemblies used in underground "delta load" centers.

SUMMARY OF THE INVENTION

The invention herein is a single phase, 4-way vacuum interrupter switch that meets the dimensional constraints imposed by utility demands while providing the safety and ecological benefits of a vacuum interrupting switch. The switch is located within the underground delta load center and, when installed, allows for the replacement of existing paper-insulated lead cables (PILC) with higher-rated synthetic cables. The switch herein is configured to fit through existing vault access holes which are typically 30 inches in diameter. Moreover, the present invention is useful in higher voltage delta single-phase vacuum switch feeders with three branch circuits as a drop-in replacement for the lower voltage oil switches currently installed in the underground delta load centers, and minimizes potential hazards such as oil leakage, explosion, and lead exposure within the confined space of underground delta load center.

Other objects, advantages and significant features of the invention will become apparent from the following detailed description, which, taken in conjunction with the annexed drawings, discloses a preferred embodiment of the invention.

It will be understood that orientations described in this specification, such as "up", "down", "top", "side" and the like, are relative and are used for the purpose of describing the invention with respect to the drawings. Those of ordinary skill in the art will recognize that the orientation of the disclosed device can be varied in practice, and that the orientation used herein has been chosen for explanatory purposes only. Similarly, it will be recognized by those skilled in the art that the materials referred to herein, and particularly those identified by trademark, are examples of materials that meet the requirements and specifications mandated by safety concerns and by the use of the invention with electric power lines. Accordingly, other acceptable materials are within the scope of the invention whether known by generic names and/or other trademarks, or comprising other functionally equivalent material.

DESCRIPTION OF THE DRAWING

In the drawing,

FIGS. 18A through 18K are illustrations of components of FIG. 12;

FIGS. 19A through 19J are illustrations of components of FIG. 12;

FIGS. 20A through 20N are illustrations of components of FIG. 12;

DETAILED DESCRIPTION OF THE PREFERRED EMBODIMENT

Figure 11:
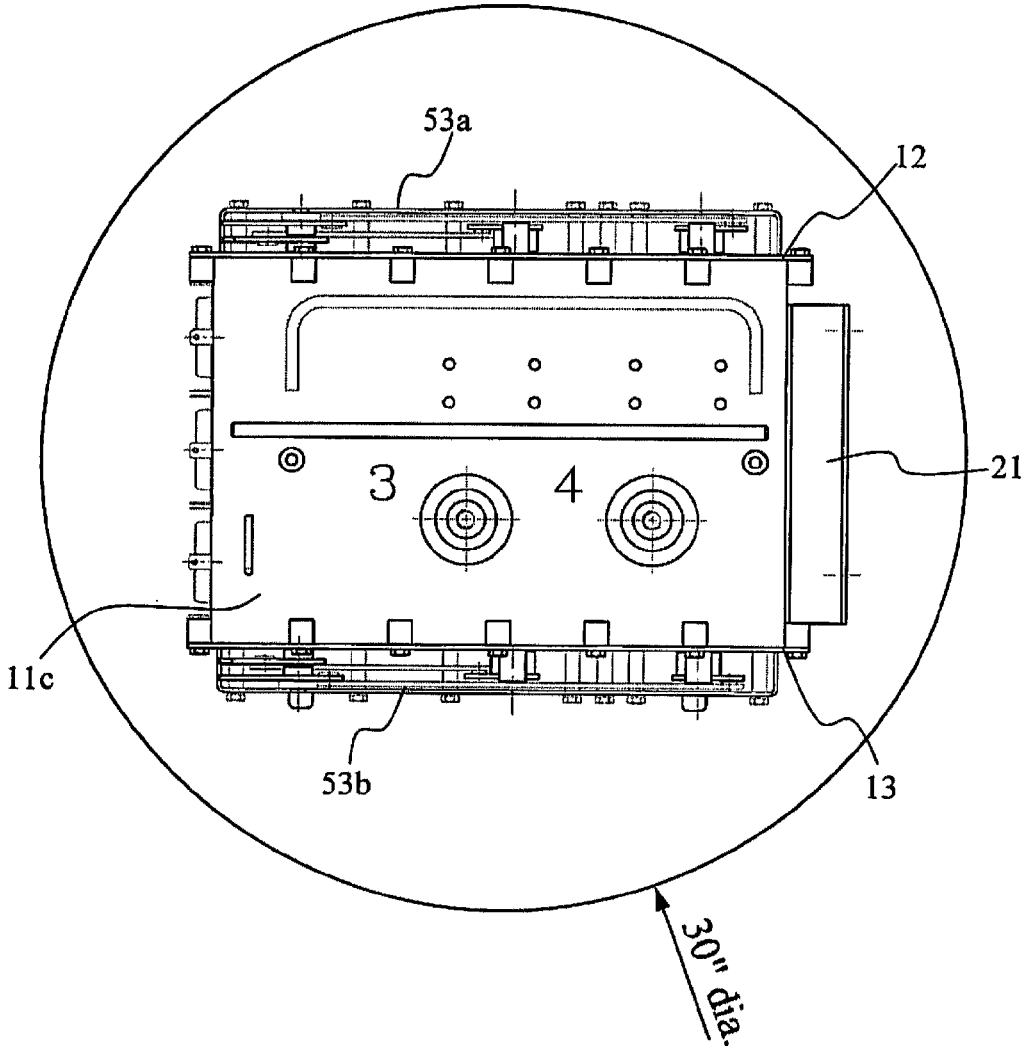
FIG. 11 is a right side elevation view of a vacuum interrupter switch assembly of FIG. 1 illustrating its passing through a round opening of 30-inch diameter.

Referring to FIGS. 1-4, a vacuum interrupter switch assembly 5 constructed in accordance with the invention is illustrated. The assembly comprises of an outer case 10 with sidings 11*a*-*d*, lid 12, and bottom 13, formed from a sturdy, corrosive-resistant material. The preferred material is stainless steel. The dimensions of the case are preferably approximately 28.8 inches wide by 16.9 inches high by 21.5 inches deep to fit within existing access holes, such as the 30-inch diameter access hole illustrated in FIG. 11, and underground spaces available for switching assemblies. Each switch assembly case 10 is filled with dry air. Neither oil nor $SF_6$ gas is used. The enclosed space may be filled with an electrically non-conductive moisture-resistant gel, if desired, once the assembly's internal components have been installed. The case 10 preferably has a welded lid 12.

Figure 1:
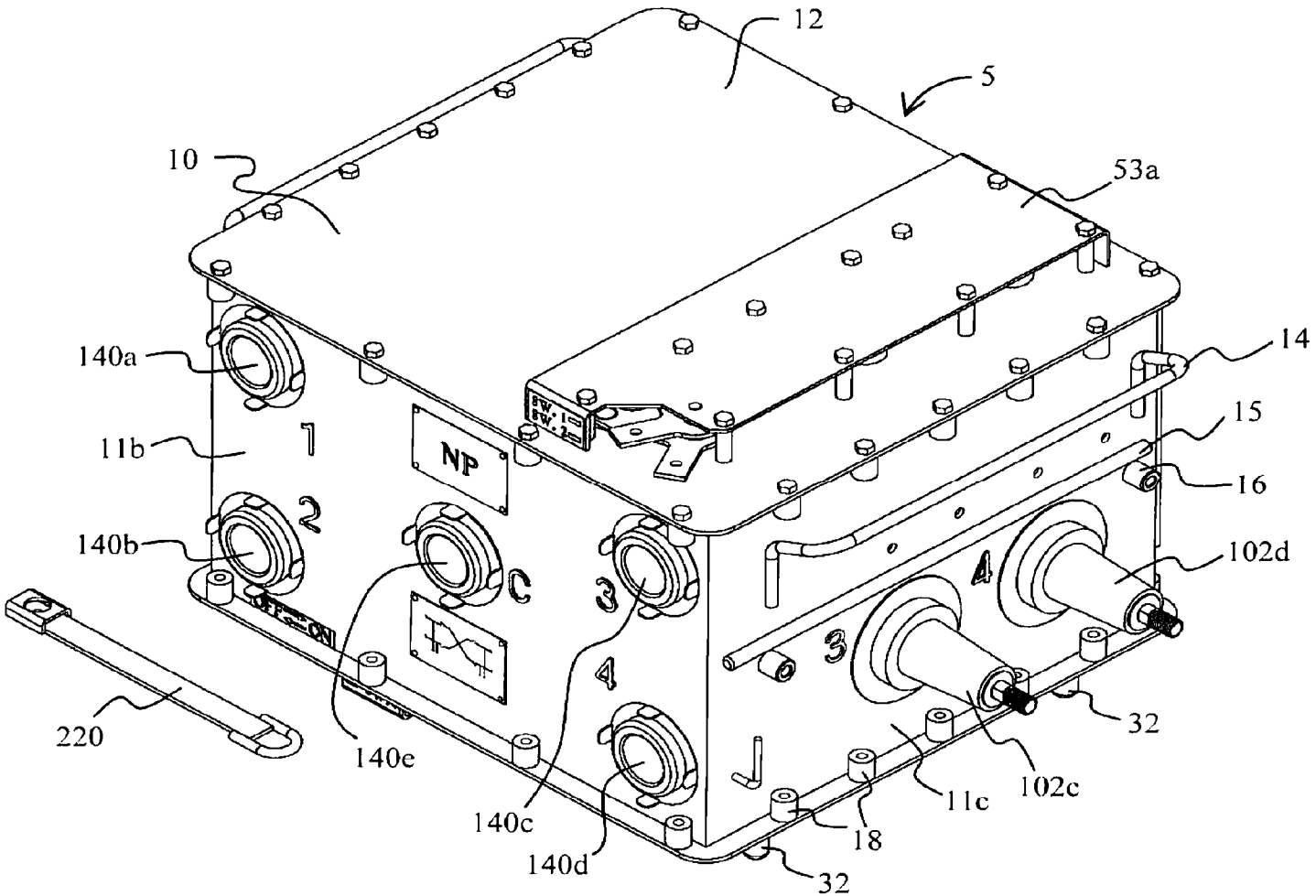
FIG. 1 is a top right angled view of a vacuum interrupter switch assembly constructed in accordance with the invention.
Figure 2:
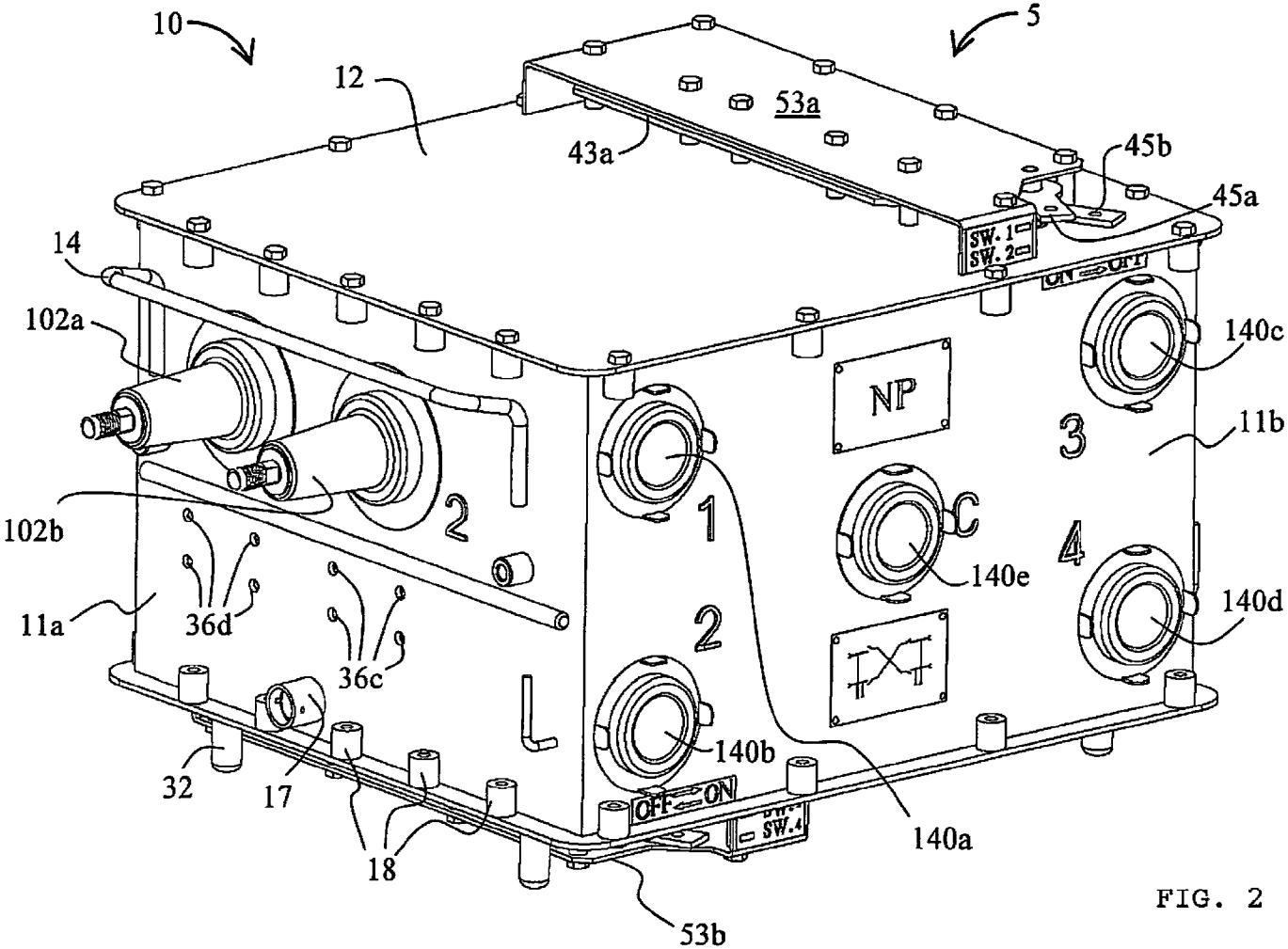
FIG. 2 is a top left angled view of the vacuum interrupter switch assembly of FIG. 1.
Figure 3:
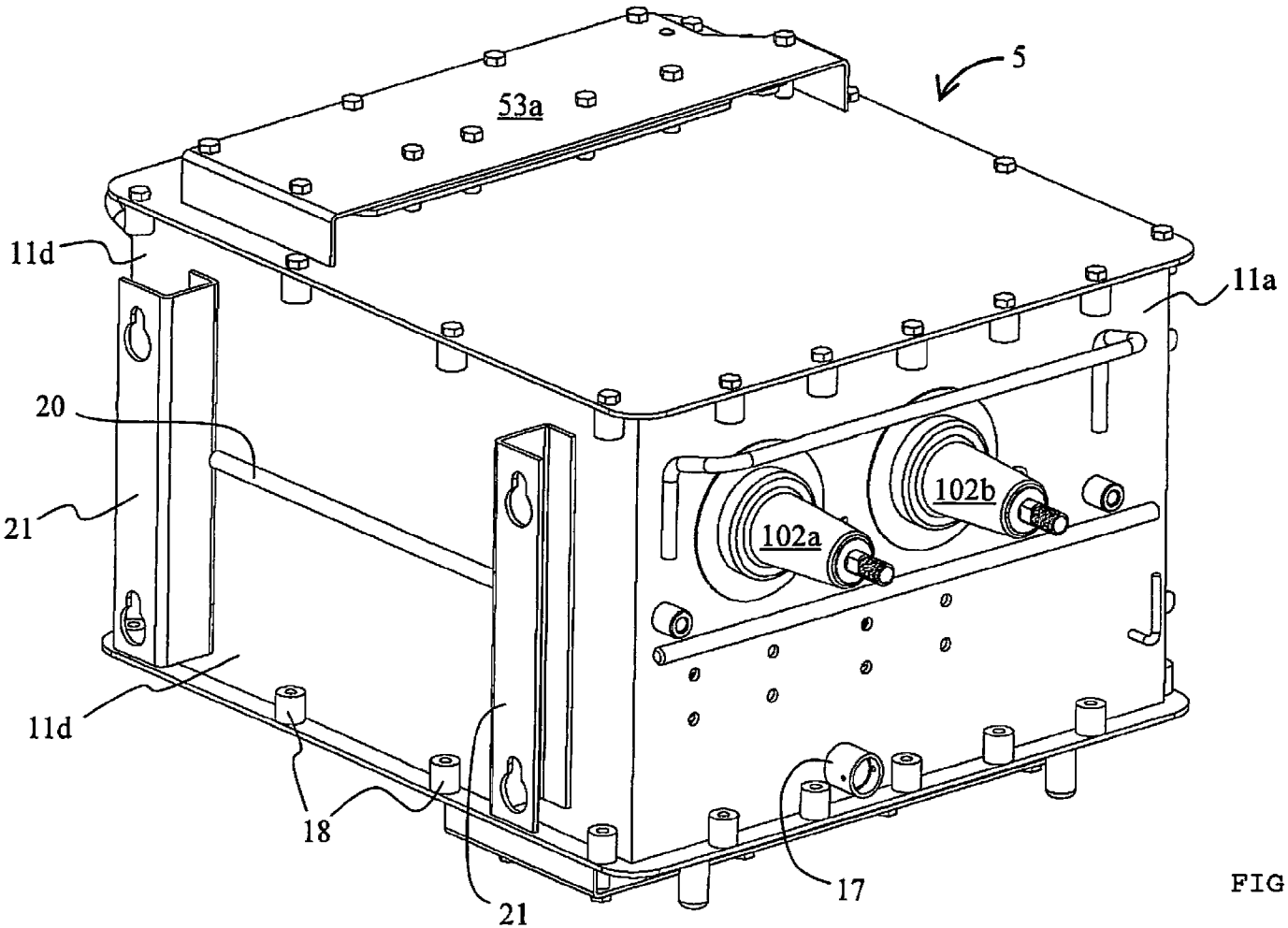
FIG. 3 is a top left rear angled view of the vacuum interrupter switch assembly of FIG. 1.
Figure 4:
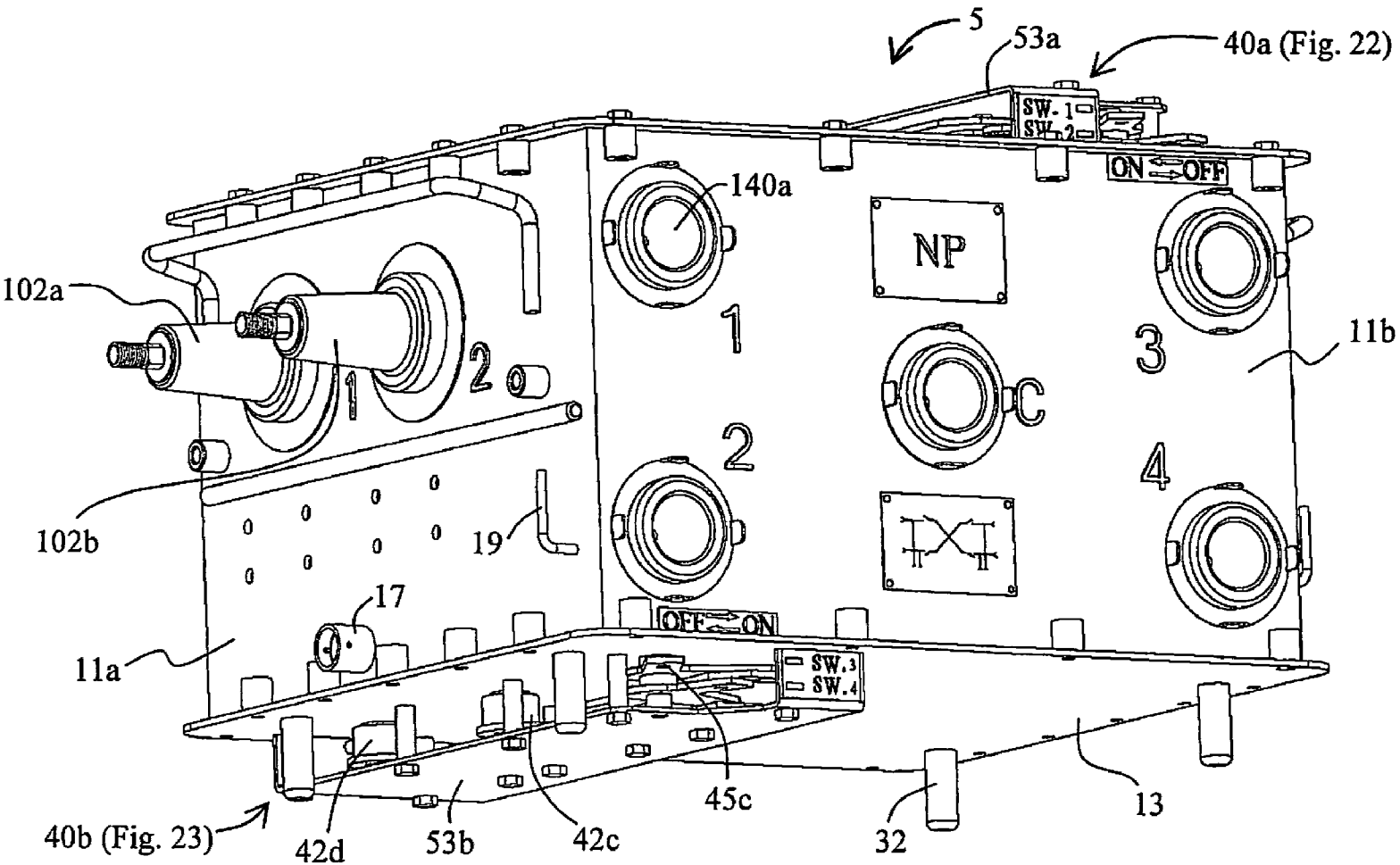
FIG. 4 is a bottom left angled view of the vacuum interrupter switch assembly of FIG. 1.

A first pair of 600 amp power bushings 102*a*, 102*b* extends from siding 11*a* of case 10. A second pair of 600 amp power bushings 102*c*, 102*d* extends from siding 11*c* of case 10. Five 200 amp bushing wells 140*a*, 140*b*, 140*c*, 140*d*, and 140*e* extend from siding 11*b* (front) of case 10. As illustrated in FIGS. 1 and 2, power bushings 102*a* and 102*b* extend from the upper region of the case, while power bushings 102*c* and 102*d* extend from the lower region of the case. In use, the incoming three-phase power feeder cable is electrically coupled to a selected one of the four power bushings. The remaining three power bushings are electrically coupled to the radial branch circuits to provide single-phase power. Because all the power bushings are rated at 600 amps, any of them may be selected as the bushing that receives the three-phase power feeder cable.

Figure 5:
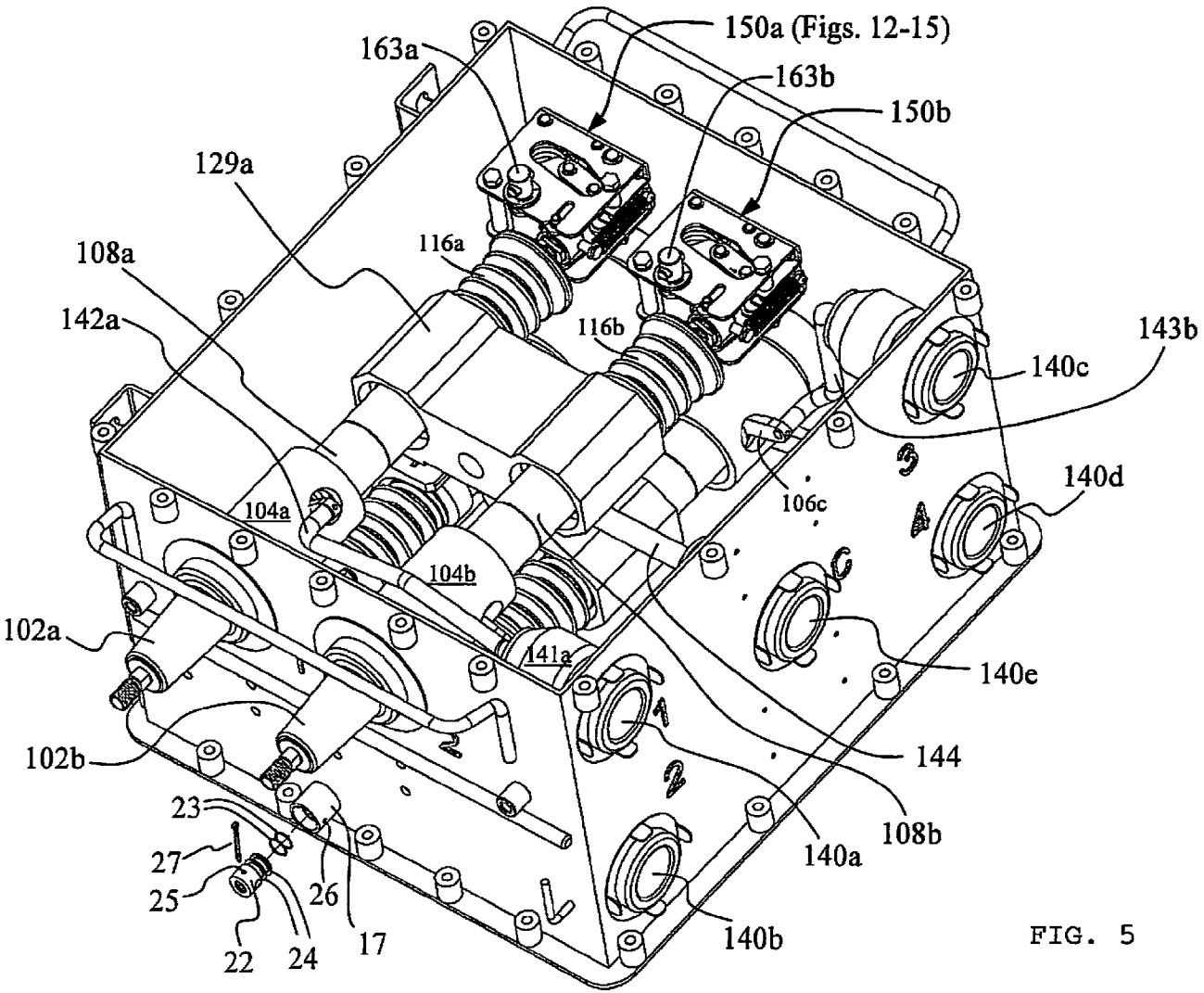
FIG. 5 is a top view of the vacuum interrupter switch assembly of FIG. 1 without the lid, and illustrating the internal layout of components.
Figure 6:
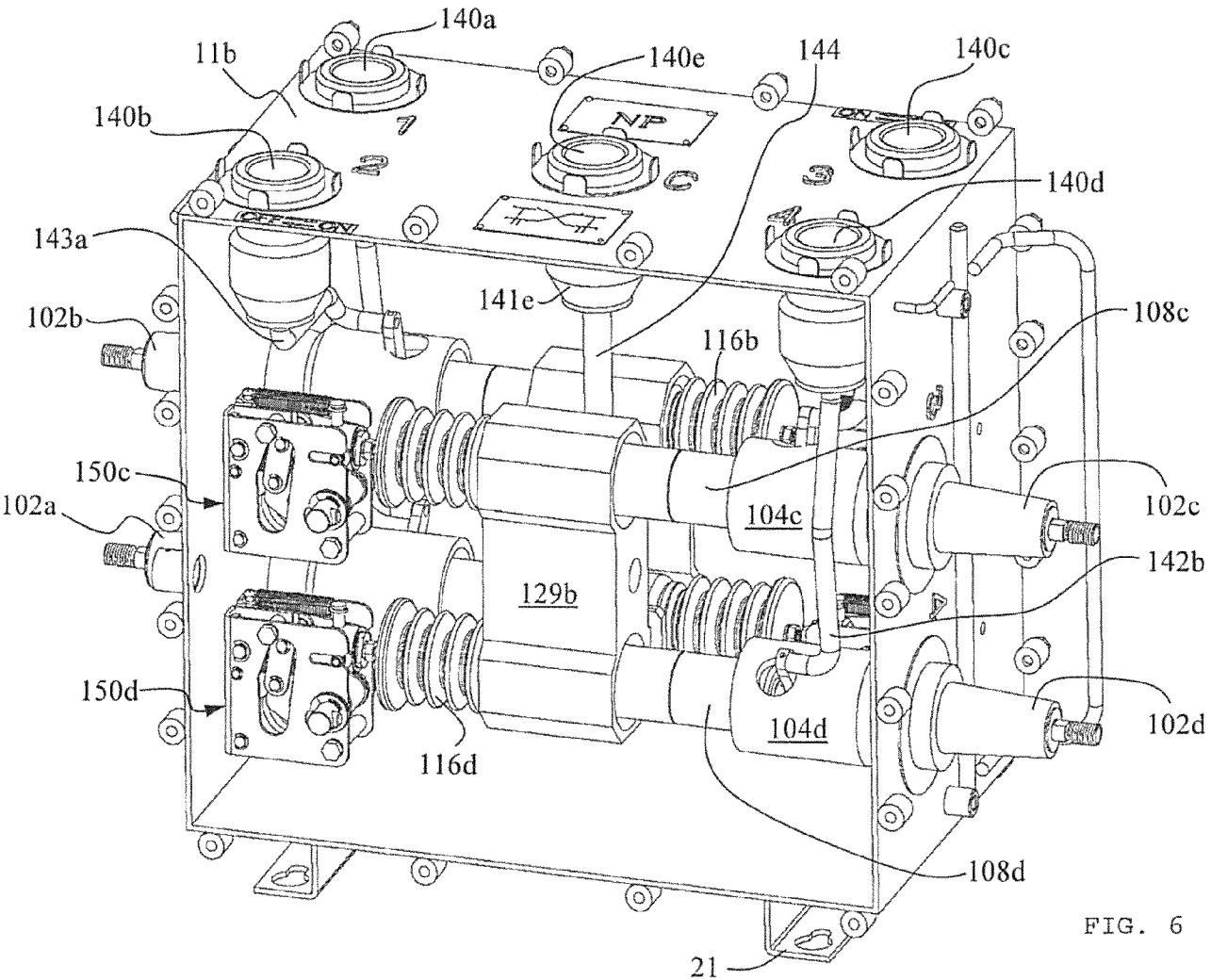
FIG. 6 is a bottom view of the vacuum interrupter switch assembly of FIG. 1 without the lid and bottom, illustrating the internal layout of components.

Referring next to FIGS. 5 and 6, the layout of the assembly's internal components is illustrated. The assembly includes four "vacuum interrupter bottle" switches 108*a*, 108*b*, 108*c*, and 108*d* electrically coupled to a respective one of the four power bushings 102*a*, 102*b*, 102*c*, or 102*d*. As illustrated in FIG. 5, vacuum interrupter bottle switch 108*a* is electrically coupled to power bushing 102*a* and extends laterally inward across the upper region of the case 10. Vacuum interrupter bottle switch 108*b* is electrically coupled to power bushing 102*b* and extends laterally inward across the upper region of the case 10, forward of vacuum interrupter bottle switch 108*a* and generally parallel thereto. As shown in FIG. 6, vacuum interrupter bottle switch 108*c* is electrically coupled to power bushing 102*c* and extends laterally inward across the lower region of the case 10 beneath vacuum interrupter bottle switch 108*b* and generally parallel thereto. The fourth vacuum bottle switch 108*d* is electrically coupled to power bushing 102*d* and extends laterally inward across the lower region of the case 10 beneath vacuum bottle switch 108*a* and generally parallel thereto.

Information regarding the general features and functions of vacuum bottle can be found in U.S. Pat. Nos. 3,305,657 and 5,589,675.

Figure 7:
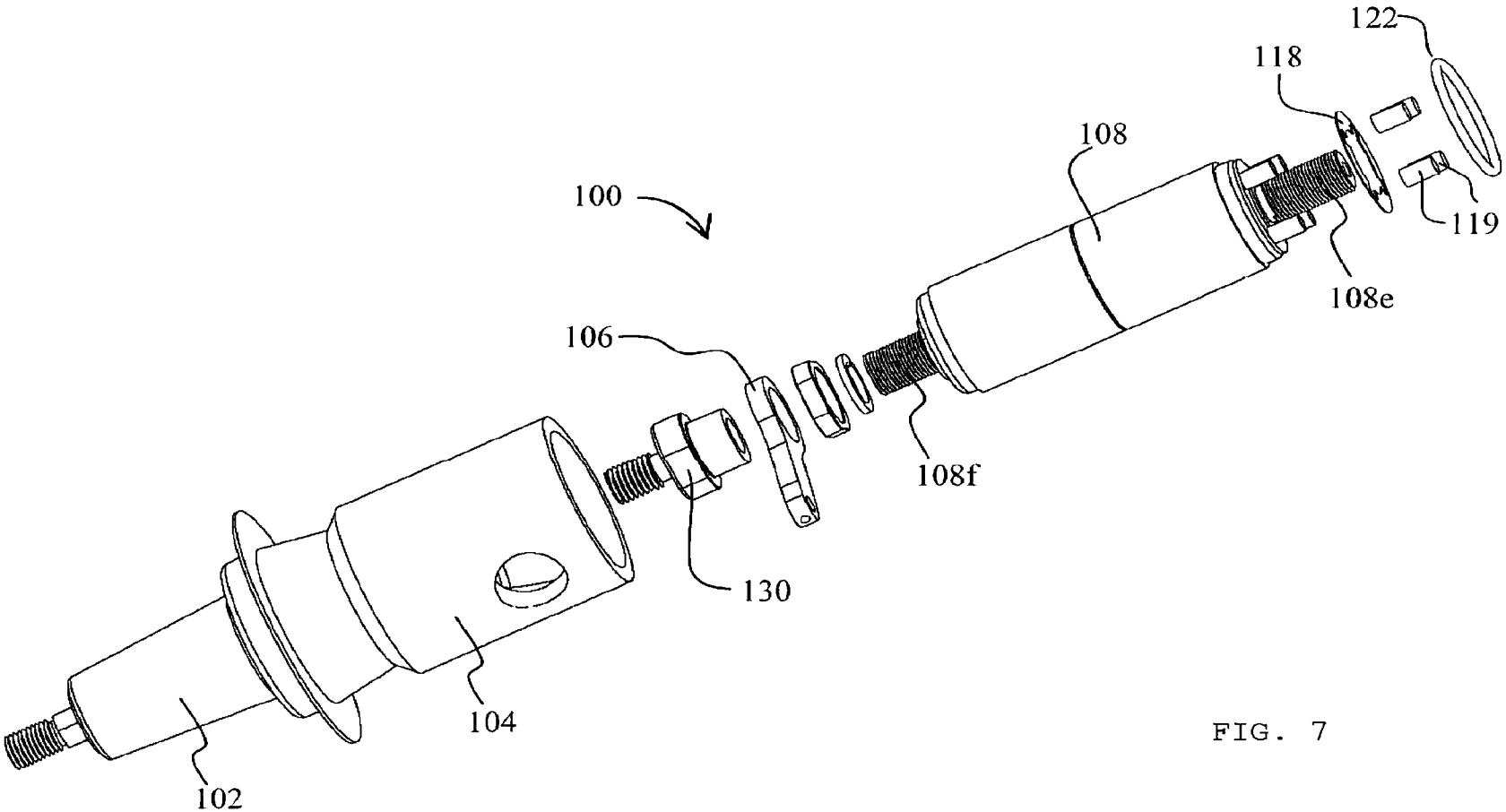
FIG. 7 is a front section expanded view of a vacuum interrupter bottle switch as illustrated in FIGS. 5 and 6.
Figure 8:
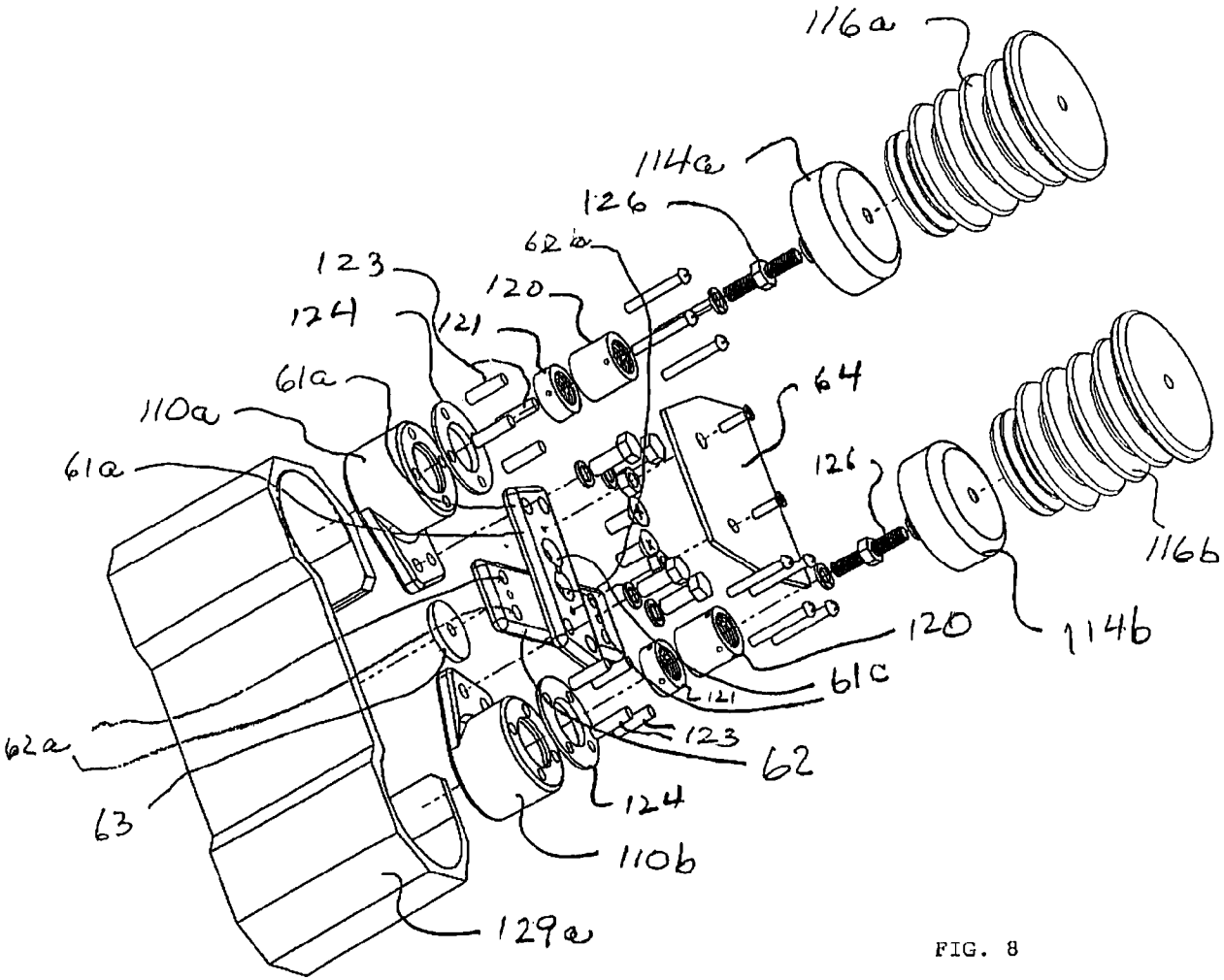
FIG. 8 is a back section expanded view of a vacuum interrupter bottle switch with common bus assembly as illustrated in FIGS. 5 and 6 without the operating mechanism assembly.
Figure 9:
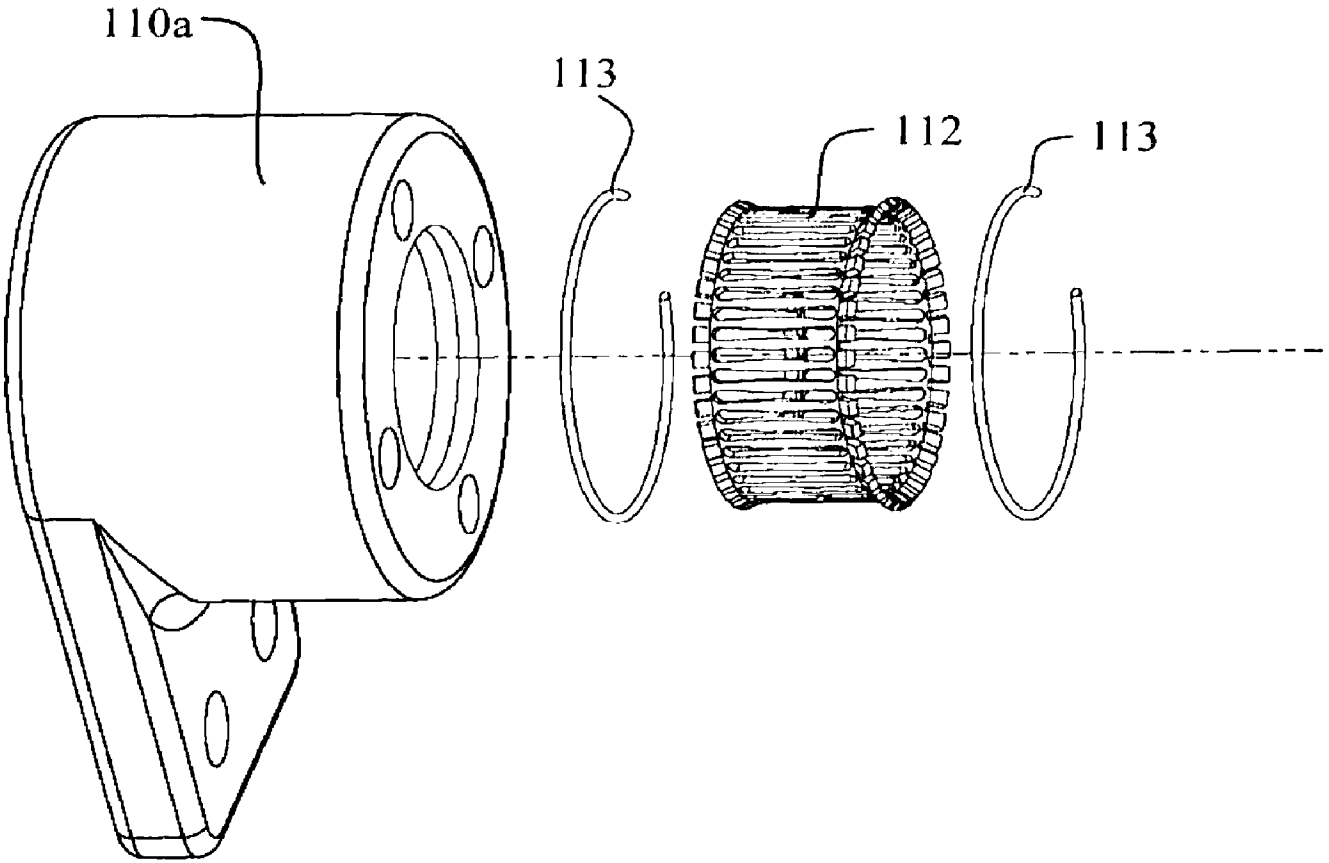
FIG. 9 illustrating a Multilam® contact and C-clips which are inside the internal groove (not shown) of a common bus connector.

Referring to FIGS. 7 and 8, the layout of the vacuum interrupter bottle switches is illustrated. A vacuum interrupter bottle 108 has one stationary contact 108*f* and one moveable contact 108*e*. As illustrated in FIG. 7, each power bushing 102 is preferably connected to the stationary contact 108*f* of the respective vacuum interrupter bottle 108 and to a respective bushing well 140*a*, 140*b*, 140*c*, 140*d* through bushing well connector 106. The moveable contact of each vacuum interrupter bottle is connected to a respective push-pull insulator (e.g., at 116*a*) and (as best illustrated in FIG. 8) is in contact with a connector (e.g., 61*a*) to a common bus assembly for all four moving contacts. A respective common bus connector 110*a*, 100*b* is bolted directly to the moveable contact end of each vacuum interrupter bottle. The interior wall of common bus connector 110*a*, 110*b* has an internally disposed band of torsion or leaf spring contact material 112, as illustrated in FIG. 9, captured therein for electrical contact between the movable contact and the common bus assembly. Contact elements of this type are sold, for example, under the Multilam trademark. The Multilam contact touches the moveable contact of a vacuum interrupter bottle switch.

Each push-pull insulator 116*a*, 116*b*, 116*c*, 116*d* is connected to a respective operating mechanism assembly 150*a*, 150*b*, 150*c*, 150*d* that is controlled by means such as a removable handle or respective control signals. In the case of removable handles, the handle is operable through a respective control arm assembly located on the exterior of the case 10; preferably on the top or bottom side of the container. Each control arm assembly can be locked in place to prevent improper operation. Each vacuum interrupter bottle switch is preferably opened and closed through the force of a compression spring located in the operating mechanism to move the contacts at a specified speed. At the base of the connector is a flat bus which connects to a common bus assembly related to all four vacuum interrupter bottle switches. A threaded insert connects the moveable contact to a push-pull insulator.

The push-pull insulator is designed to isolate the grounded manually operated mechanism of the energized vacuum interrupter bottle switch when the movable contact is in the closed position. The push-pull insulator is made of an epoxy resin, and is shaped as a station-type insulator. A cup-shaped insulator provides additional insulation when the vacuum interrupter bottle switch is in the closed position. Both ends of the push-pull insulator have threaded bolts that are secured in place using a locking nut.

Figure 10:
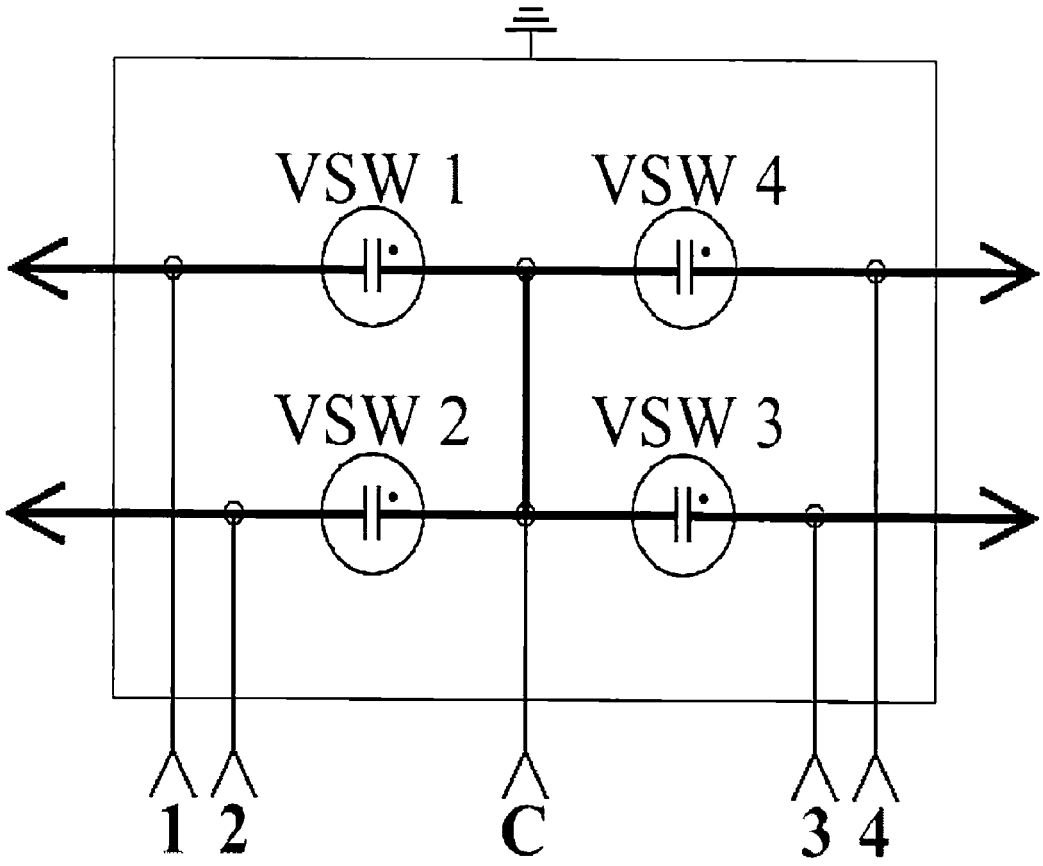
FIG. 10 is a wiring diagram illustrating the major electrical connections within the vacuum interrupter switch assembly.

The connection of each bushing well 140*a*, 140*b*, 140*c*, 140*d* directly to a respective power bushing 102*a*, 102*b*, 102*c*, 102*d*, respectively (as illustrated in FIGS. 5, 6, and 10) allows checking of the potential and grounding of the power circuit as well as allowing emergency power input to the power circuit during an outage due to loss of power to the feeder circuit. The fifth bushing well 140*e* is connected to the common bus assembly 60 so as to provide a ground in checking for voltage and to provide a point for measuring the vacuum interrupter bottle switch contact resistance. The design functions of the four bushing wells 140*a*, 140*b*, 140*c*, 140*d* are to:

1. ground a de-energized branch circuit as required.
2. determine if the circuit is energized. A high voltage voltmeter can be used to determine the voltage magnitude between phases (A-B; B-C; C-A).
3. provide a temporary source of electric power to the branch circuit under an emergency condition in the event a feeder is de-energized.
4. measure with instruments, without removal from the case, the vacuum interrupter bottle switches' contact resistances and vacuum dielectrics when the vacuum interrupter switch assembly is de-energized.

Each power bushing 102*a*, 102*b*, 102*c*, 102*d* is preferably connected directly to the stationary contact of a respective vacuum interrupter bottle switch via a threaded connector. The bottom side of the connector contains a bus for connection to a 200 A jumper with a threaded connector from the bushing well. The gap between the 600 A bushing and the vacuum interrupter bottle switch insulation is increased using a mold of epoxy resin.

Each case 10 has ground rods 19 welded on the left and right side of the case. Choosing a side, the three installed vacuum interrupter switch assemblies are grounded and bonded together with a ground cable connected to the ground rod 19. The cable should be connected to a low impedance ground to provide: a) protection by limiting voltage stress to the energized components and b) maximum safety to persons who operate or come in contact with the container when it is energized.

With the availability of this new switch assembly, the existing PILC can be replaced with synthetic cable. The utilization of the bushings allows connection to the vacuum interrupter switch assemblies via synthetic power cable elbows such as those manufactured under the Elastimold trademark by Thomas & Betts Corporation (Memphis, Tenn., USA) and under the Cooper trademark by Cooper Power Systems (Waukesha, Wis., USA). For this invention, Elastimold is the preferred brand. With the oil switch assemblies, bushings are not used so synthetic power cable elbows cannot be connected. The oil switches have metal end caps to which holes are drilled so that PILC can be inserted into the oil switch. In order to secure the cable to the oil switch, lead swipes are used. The use of bushings foregoes this toxic process.

An underground delta load center usually has a 30-inch diameter access hole. This size hole is large enough for three of the disclosed assemblies to fit through, end first, one at a time. For installation, two stainless steel wall mounting brackets are installed onto the wall first. The first assembly is preferably installed at the lowest point on the wall mounting brackets and provides a shelf for lifting and landing the next assembly in place. Mounting brackets with slotted holes are preferably located on the back side of the case 10 for easy installation.

A summary of other features and other specifications attributable to the assembly herein are shown below.

Capabilities

600A Loadbreak 4-Way Vacuum Interrupter Switch
200A Loadbreak 4-Way Vacuum Interrupter Switch
200A 1-Way Vacuum Interrupter Switch
200A Bushing Voltage Checking
200A Phase Grounding
200A Power Input Features No oil and no SF6 gas. Interrupting is inside vacuum interrupter.
Standard bushing and bushing wells. IEEE/ANSI
Submersible, compact and light-weight design.
Manual operation.
All mechanisms and switch tank are made of stainless steel.
All lines and common bus are individually accessible through 200A brushing wells.
Optional molecular sieves.

Benefits

Environmentally friendly. Maintenance-free and safe operation and long service.
Ease of cable connection.
Best choice for underground applications. Can fit through 30" dia. maintenance holes.
No special operation tools requirement.
Corrosion-free service.
Ease in grounding or detection.
Increased moisture protection.

If smaller dimensions are desired, oil or $SF_6$ can still be used in the disclosed assembly as a dielectric medium.

The assembly of the preferred vacuum interrupter switch assembly will now be discussed.

Figure 12:
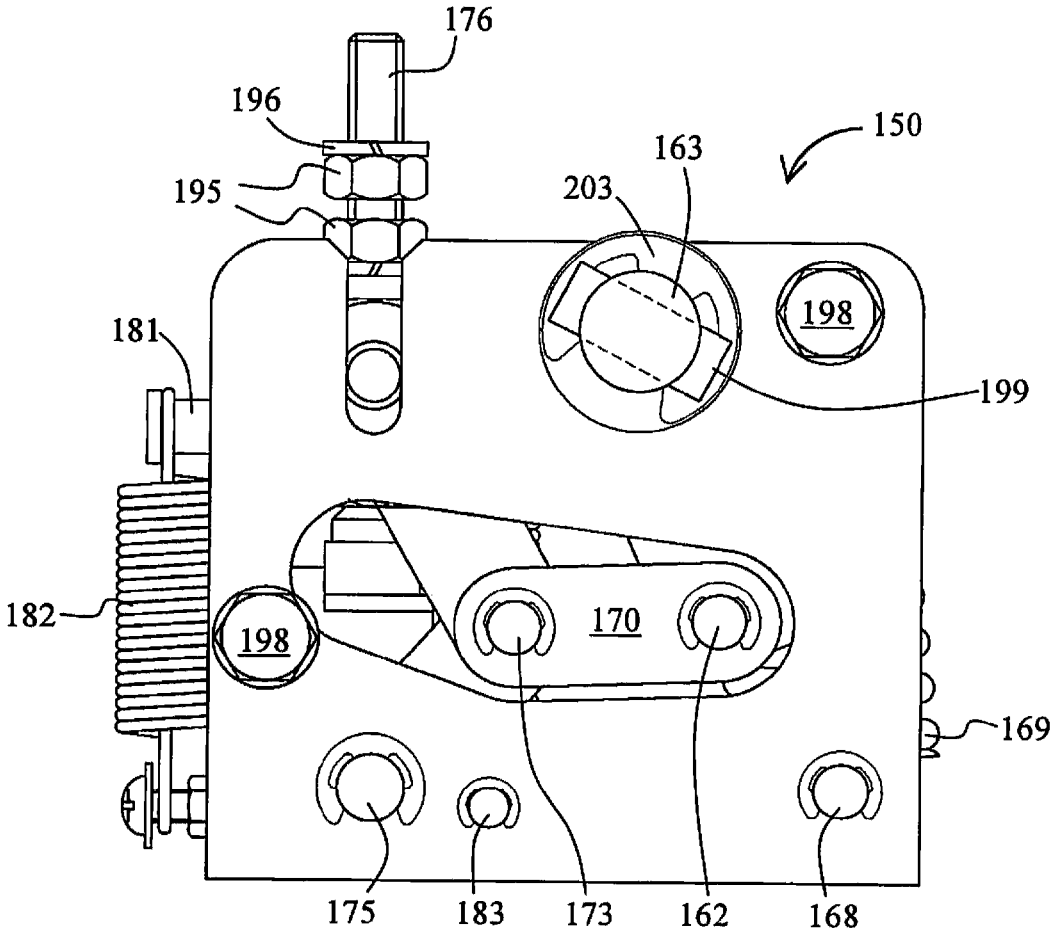
FIG. 12 is a top plan view of the operating mechanism assembly according to the present invention.
Figure 13:
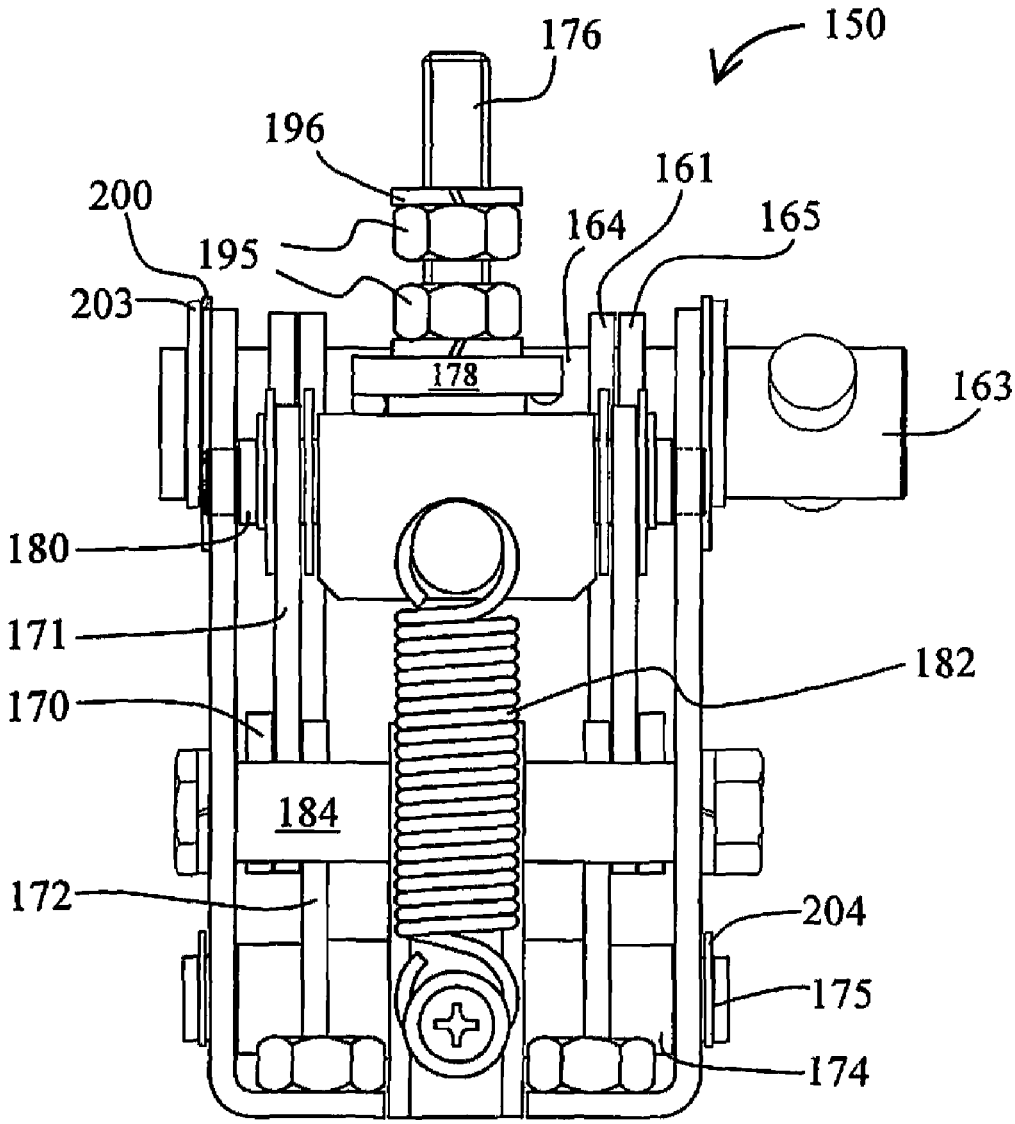
FIG. 13 is a side elevation view of the operating mechanism assembly of FIG. 12.
Figure 14:
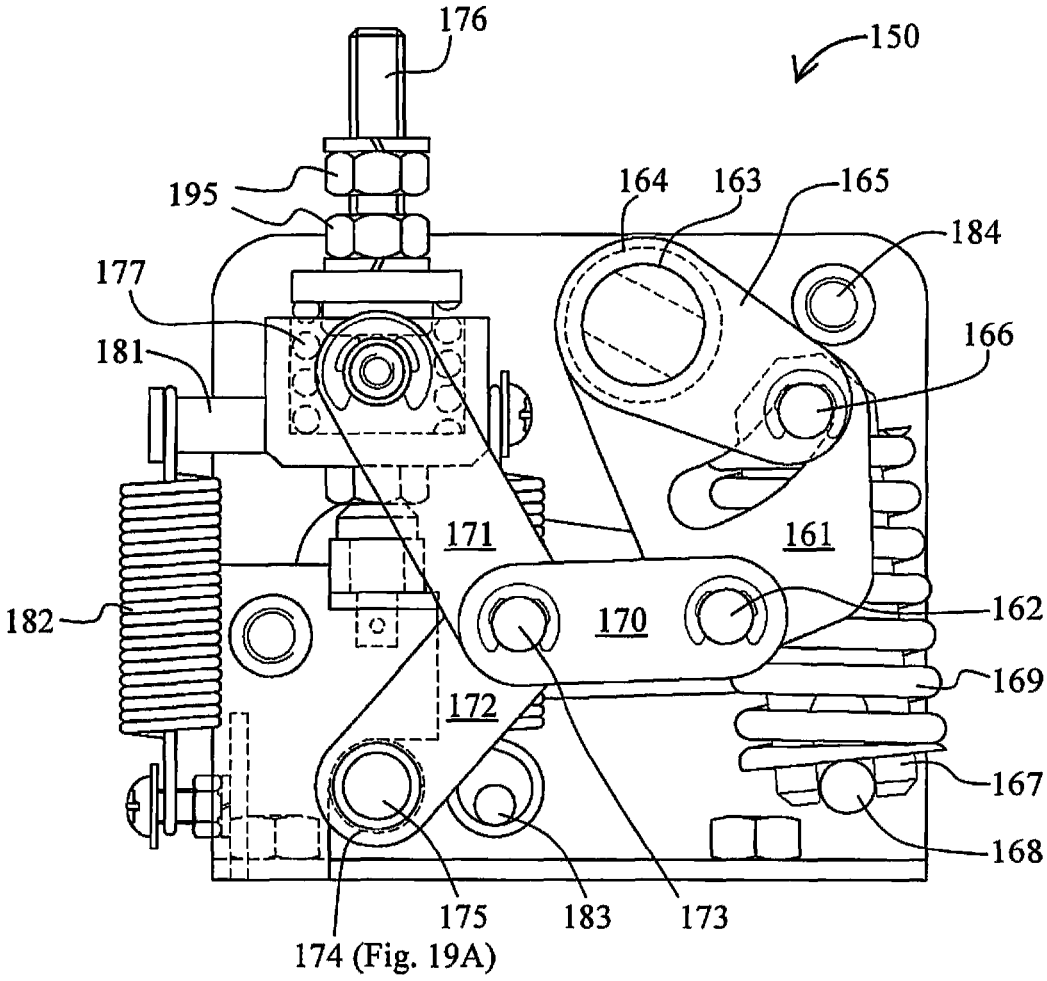
FIG. 14 is an internal view of the operating mechanism assembly of FIG. 12.
Figure 15:
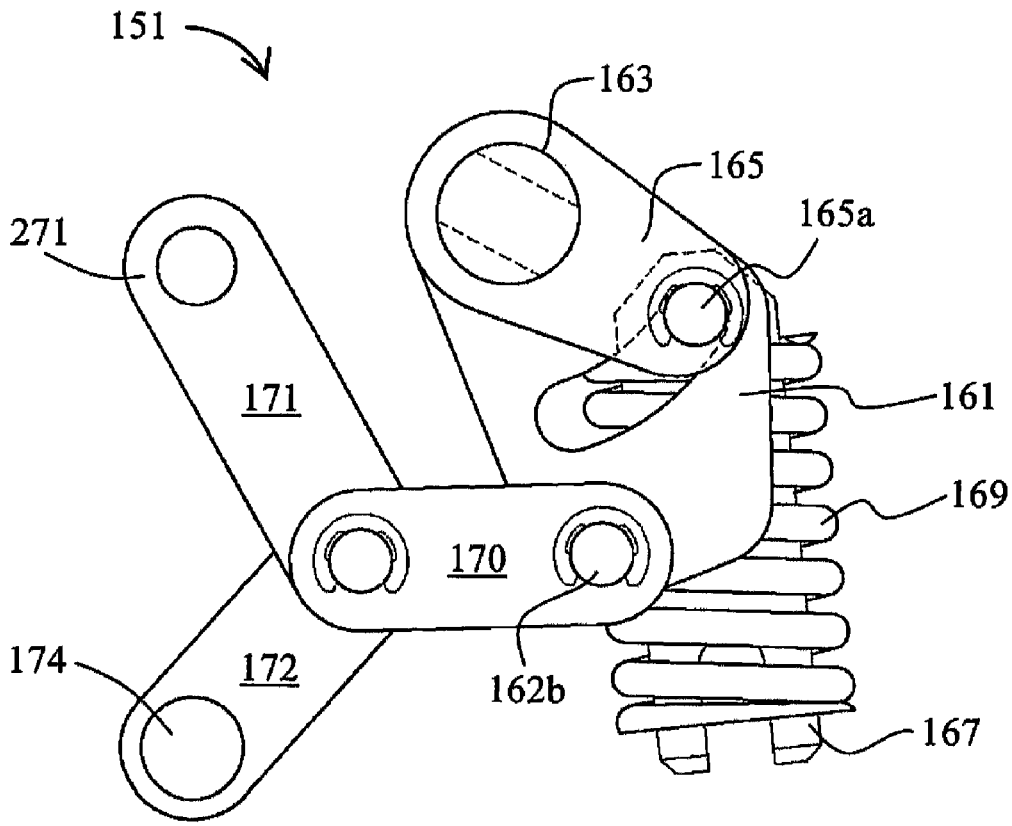
FIG. 15 is an illustration of the draft shaft assembly of FIG. 12.

FIGS. 12-14 show views of an operating mechanism assembly 150 according to the present invention. The operating mechanism assembly 150 is generally comprised of a drive shaft assembly, push-pull assembly, damper assembly, and framing components. According to the present invention, four operating mechanisms are used and designated as 150*a*, 150*b*, 150*c*, and 150*d* (in FIGS. 5 and 6).

Referring to FIGS. 15, 18A through 18K and 19A through 19J, the drive shaft assembly is assembled with drive shaft 163 fitted through clevis shaft 164 of clevis 161 and rotating clevis 165. Spring shaft 167 is secured to clevis 161 and rotating clevis 165 by inserting pin 166 through holes 165*a*, curved slots 161*a*, and pivot point 167*a*. Spring 169 is slid onto spring shaft 167 and held in place with screws at points 167*c*. Pin 166 is fastened by retaining washers 205. End 170*c* of toggle link 170*a* is fastened to pivot point 162*a* with retaining washer 205. End 170*d* of toggle link 170*a* along with end 171*c* of toggle link 171*a* is fastened by retaining washers 205 to pivot point 173*a* of clevis 172. Toggle link 170*b* is substantially identical in structure to toggle link 170*a*. One end of toggle link 170*b* is fastened to pivot point 162*b* with retaining washer 205. End 170*c* of toggle link 170*b* along with the end 171*c* of toggle link 171*b* is fastened by retaining washers 205 to pivot point 173*b* of clevis 172. Toggle link 171*b* is substantially identical in structure to toggle link 171*a*.

Figure 16:
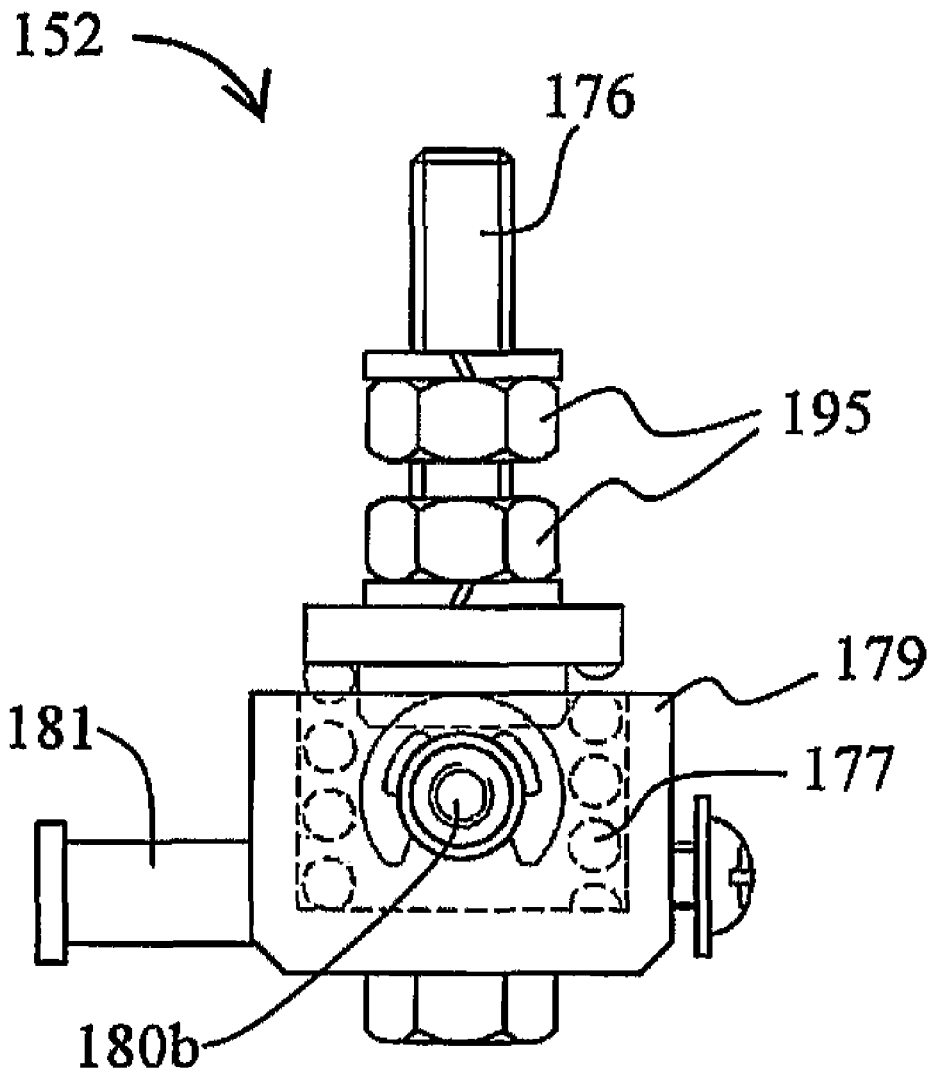
FIG. 16 is an illustration of the push-pull assembly of FIG. 12.

Referring to FIGS. 16 and 19, the push-pull assembly is assembled with bolt 176 inserted into hole 179*e* of spring container 179 and through over-travel spring 177. Spring holder 178 is screwed down onto bolt 176 to hold over-travel spring 177 in place. A spring washer 196, two nuts 195, and a second spring washer 196 are screwed onto bolt 176. Pivot studs 180*a* and 180*b* are welded into spring container 179 at holes 179*a* and 179*b*, respectively. After end 282 of spring 182*a* is attached to spring support 181, spring support 181 is welded into hole 179*c* of spring container 179. After end 283 of spring 182*b* is attached to support screw 194 with washer 191, support screw 194 is screwed into hole 179*d*. Spring 182*b* is substantially structurally identical to spring 182*a*.

Figure 17:
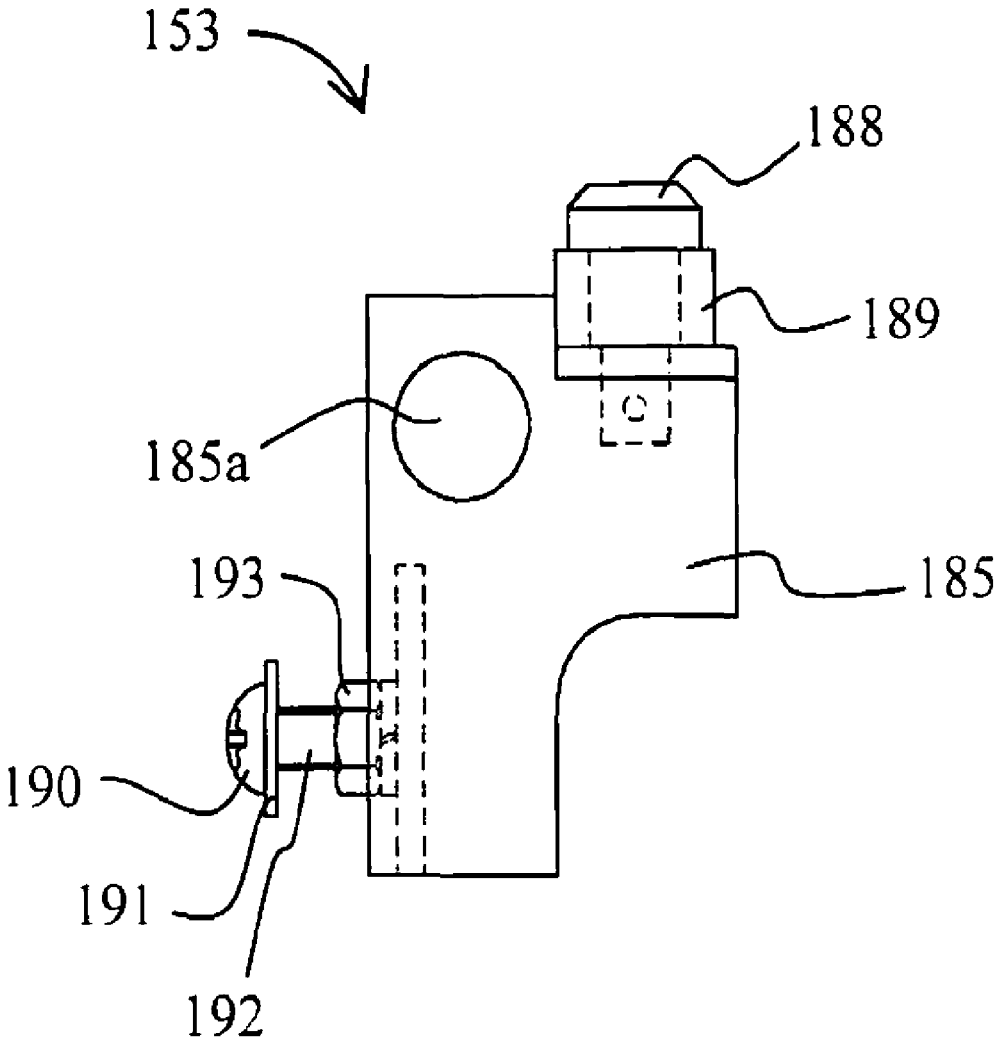
FIG. 17 is an illustration of the damper assembly of FIG. 12.
Figure 21A:
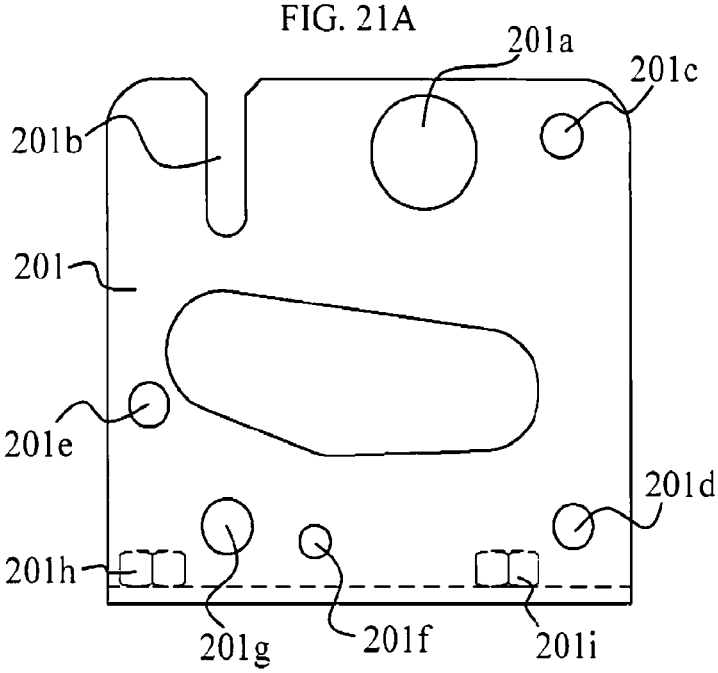
FIGS. 21A through 21H are illustrations of components of FIG. 12.
Figure 21B:
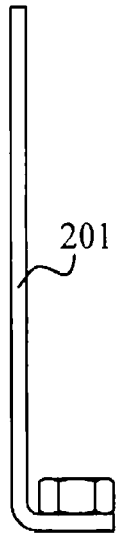
Figure 21C:
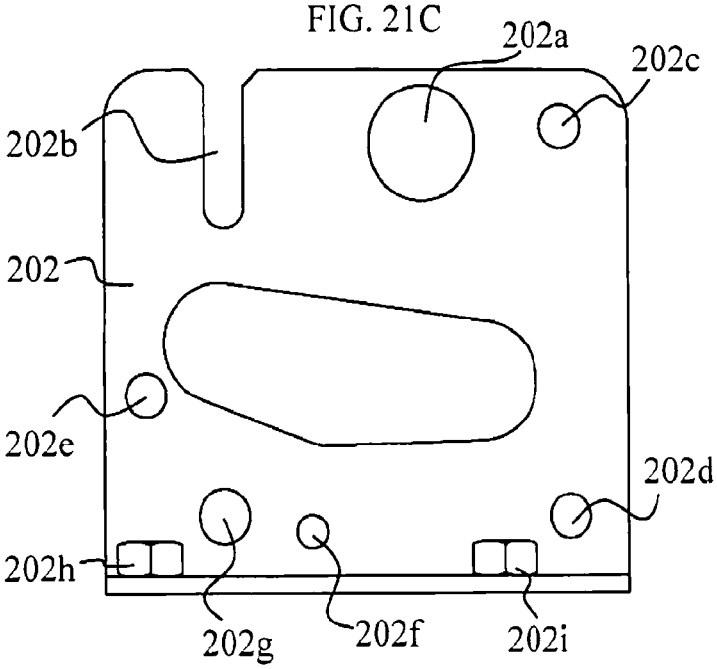
Figure 21D:
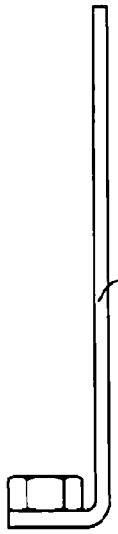
Figure 21E:
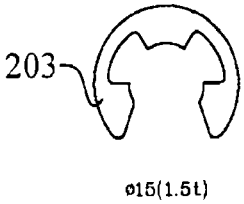
Figure 21F:
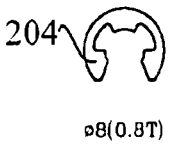
Figure 21G:
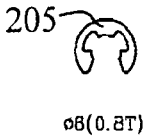
Figure 21H:
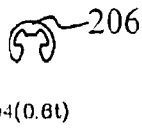

Referring to FIGS. 17 and 20, the damper assembly 153 includes a stopper 188 which is inserted through spacer 189, through hole 186 on support 185 and held in place with a cotter pin. Support screw 190 is fitted with flat washer 191, nut 193 and spring washer 192 and then screwed into hole 187 of support 185.

Drive shaft assembly 151 is connected to push-pull assembly 152 by fastening end 271 of toggle link 171*a* to pivot stud 180*a* of spring container 179 with retaining washer 204 and fastening end 271 of toggle link 171*b* to pivot stud 180*b* of spring container 179 with retaining washer 204.

Referring to FIGS. 20A through 20N and 21A through 21H, flanged spacers 200 are inserted into hole 202*a* on frame 202 and hole 201*a* on frame 201 from the non-flanged side. End 163*a* of drive shaft 163 is inserted into flanged spacer 200 of frame 202 and fastened with retaining washer 203. Pivot stud 180*a* is inserted into slot 202*b* on frame 202. Bolt 197 is inserted into hole 202*c* of frame 202 and screwed into threaded spacer 184*a* at end 184*c*. A second bolt 197 is inserted into hole 202*e* of frame 202 and screwed into threaded spacer 184*b* at end 184*c*. Pivot rod 175 is inserted into pivot shaft 174 of clevis 172 with end 175*a* inserted into hole 202*g* and fastened in place with retaining washer 204. Damper assembly 153 is installed onto spacer 184*b* through hole 185*a* and positioned between the arms of clevis 172 supporting pivot shaft 174 at support point 185*b*.

Additionally referring to FIGS. 18A through 18K and 19A through 19J, end 163*b* of drive shaft 163 is inserted through flanged spacer 200 of frame 201 and fastened with retaining washer 203. Pivot stud 180*b* is inserted into slot 201*b* on frame 201. Bolt 198 is inserted into hole 201*c* of frame 201 and screwed into threaded spacer 184*a* at end 184*d*. A second bolt 198 is inserted through hole 201*e* of frame 201 and screwed into threaded spacer 184*b* (which is substantially the same in structure as 184*a*) at end 184*d*. End 175*b* of pivot rod 175 is inserted through hole 201*g* and fastened into place with retaining washer 204. Rod 183 is inserted through hole 202*f*, spring end 283, and into hole 201*f*. Retaining washers 206 fasten rod 183 into place. Pin 168 is inserted through hole 202*d*, slot 167*b*, through hole 201*d* and fastened in place with retaining washers 205. Spring end 283 is hooked onto support screw 190. Lever rod 199 is inserted into drive shaft hole 163*c*. Remove the screws from points 167*c*.

Common Bus Assembly

FIGS. 8, 25, 26, and 27 show views of a common bus assembly according to the present invention. Common bus assembly generally includes trapezoidal-shaped bus 61*a* and 61*b* screwed into place on opposite sides and opposite ends of rectangular-shaped bus 62. The shorter sides face away from each other. Holes 61*c* of trapezoidal-shaped bus 61*a* and holes 62*a* of rectangular bus 62 are used to screw the two buses together. Holes in trapezoidal-shaped bus 61*b* and holes in rectangular bus 62 are used to screw the two buses together.

Housing Assembly

FIGS. 1-4 show views of the housing 10 according to the present invention. Housing 10 generally includes tank sidings 11*a* through 11*d*, bottom 13, and lid 12. Bottom 13 has footings 32 preferably welded to it and control assembly 40*b* and control assembly cover 53*b* bolted securely to it with holes along its edges for bolting to the threaded bolting studs 18 on tank sidings 11*a*, 11*b*, 11*c*, and 11*d*. Lid 12 has control assembly 40*a* and control assembly cover 53*a* bolted securely to it. See FIGS. 22 and 23.

Tank siding 11*a* has handle 14, stabilizing bar 15, threaded lifting studs 16, gas vent 17, threaded bolting studs 18, a grounding stud 19 and holes for power bushing 102*a* and 102*b*. Tank siding 11*b* has threaded bolting studs 18 and holes for bushing wells 140*a*, 140*b*, 140*c*, 140*d*, and 140*e*. Tank siding 11*c* has handle 14, stabilizing bar 15, threaded lifting studs 16, threaded bolting studs 18, grounding stud 19 and holes for power bushing 102*c* and 102*d*. Tank siding 11*d* has a stabilizing bar 20, threaded bolting studs 18 and mounting brackets 21. All components on the tank sidings are welded to the siding. After the internal components have been welded or bolted into place, bottom 13 and lid 12 are bolted and welded to tank sidings 11*a*, 11 *b*, 11*c*, 11*d*.

Referring to FIG. 5, O-rings 23 are fitted into grooves 24 on gas vent plug 22 and inserted into gas vent 17. Holes 26 of gas vent 17 and holes 25 of gas vent plug 22 are aligned and cotter pin 27 is inserted.

Figure 22:
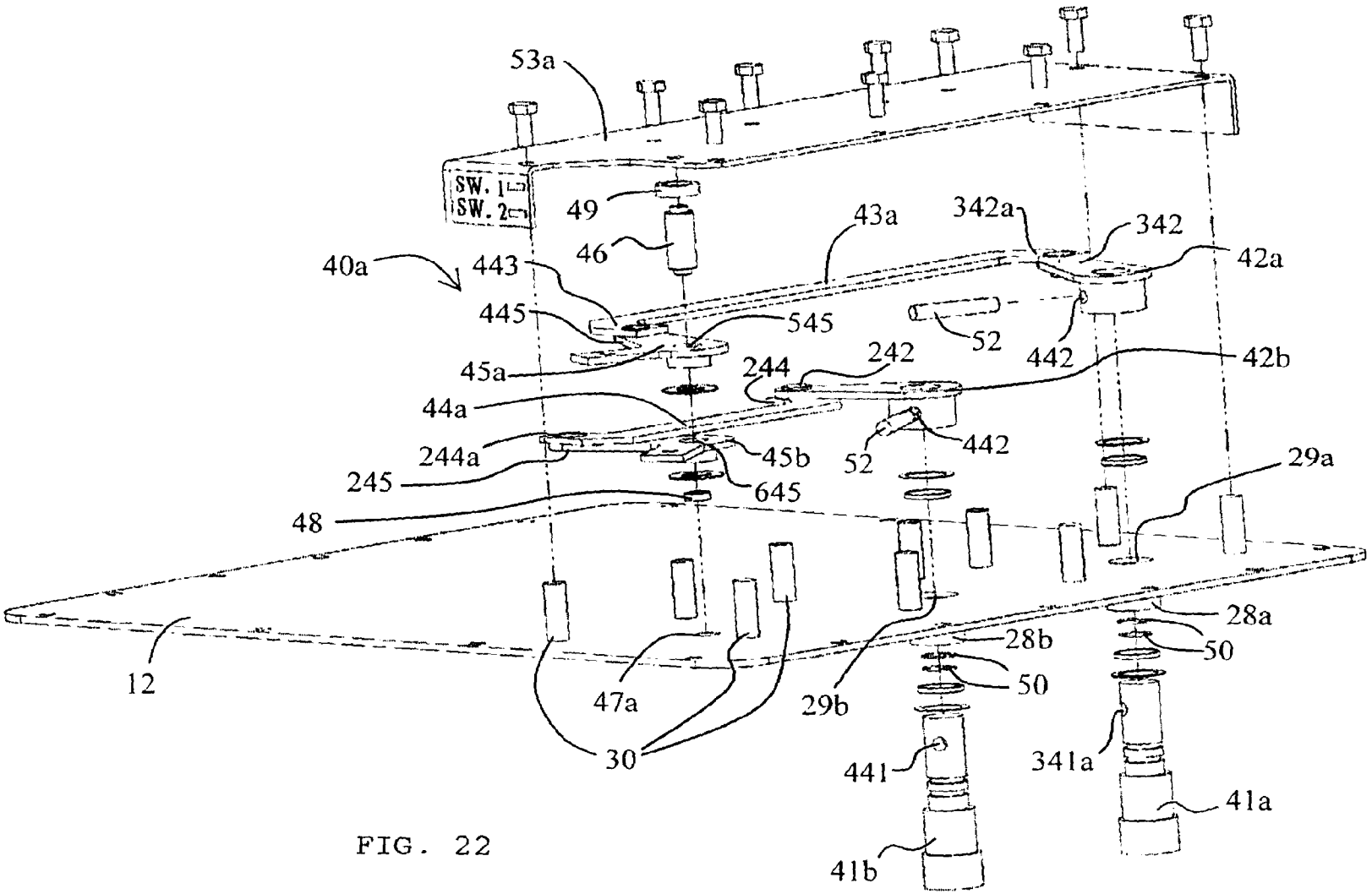
FIG. 22 is an expanded illustration of the top control assembly of FIG. 1.
Figure 23:
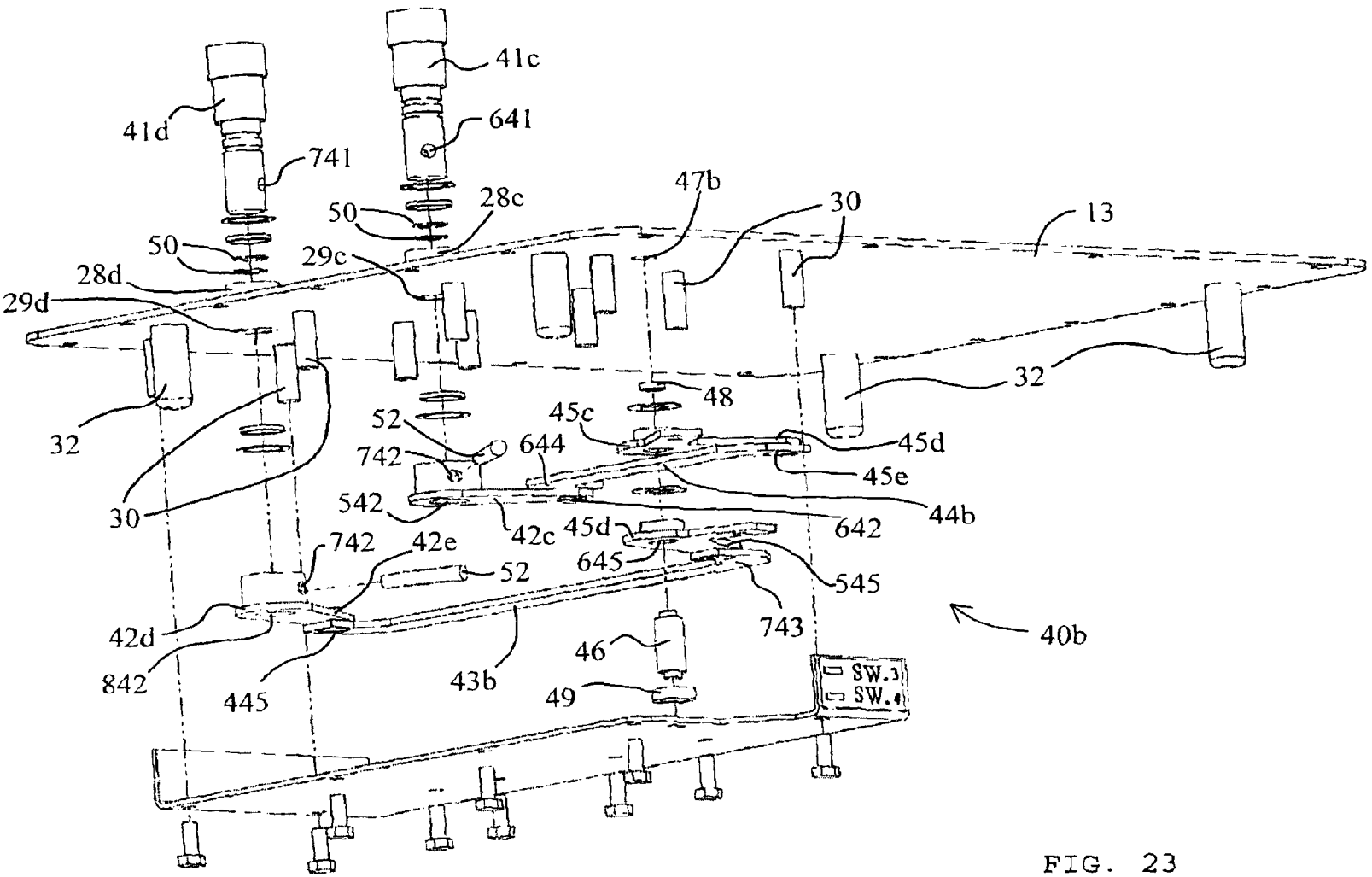
FIG. 23 is an expanded illustration of the bottom control assembly of FIG. 4.
Figure 24:
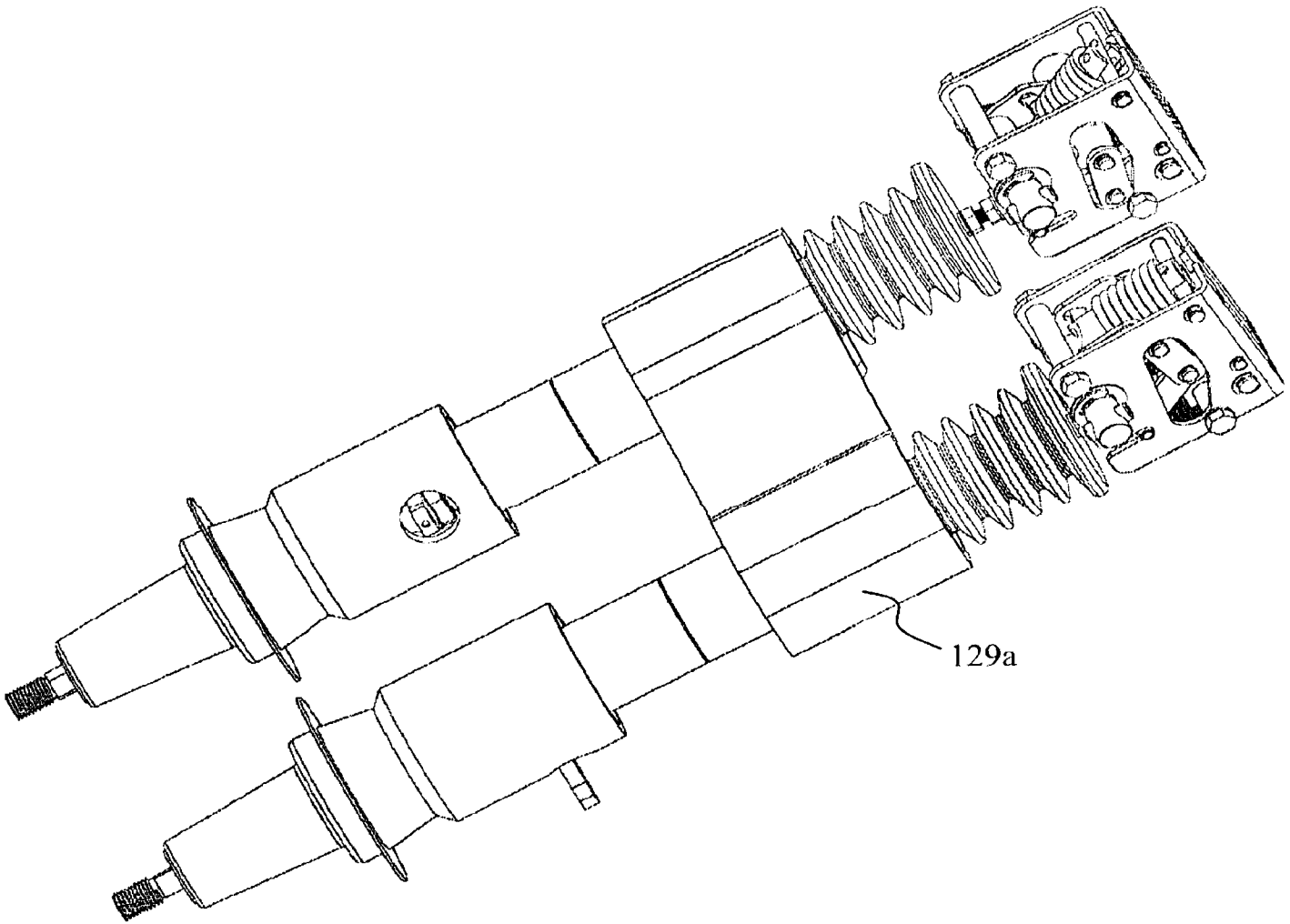
FIG. 24 is an assembled view of the vacuum interrupter bottle switch assembly as illustrated in FIGS. 5 and 6.
Figure 25:
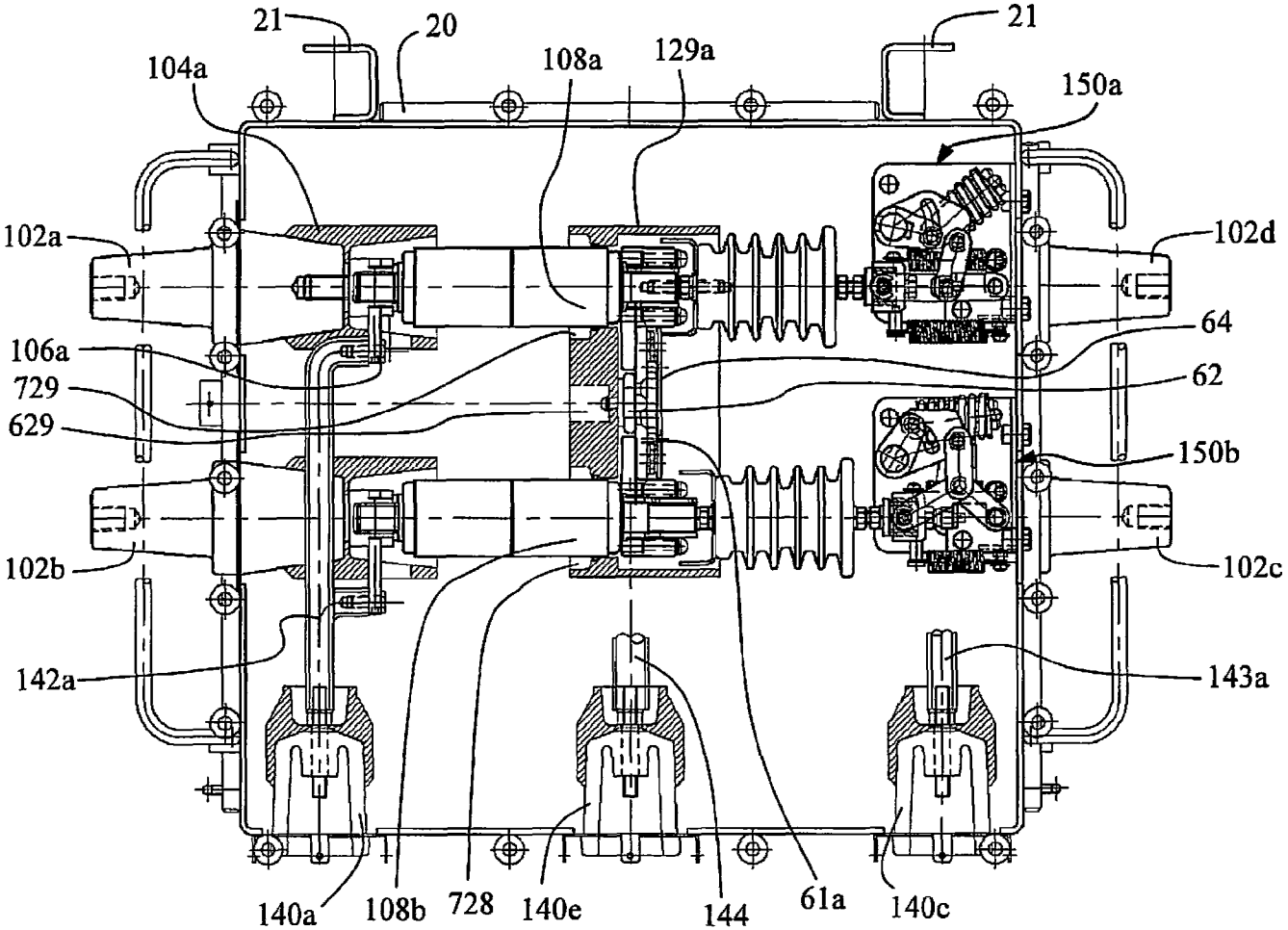
FIG. 25 is a cut-away top plan view of the vacuum interrupter switch assembly of FIG. 1, with its operating mechanism in cut-away view and some components not shown for clarity.
Figure 26:
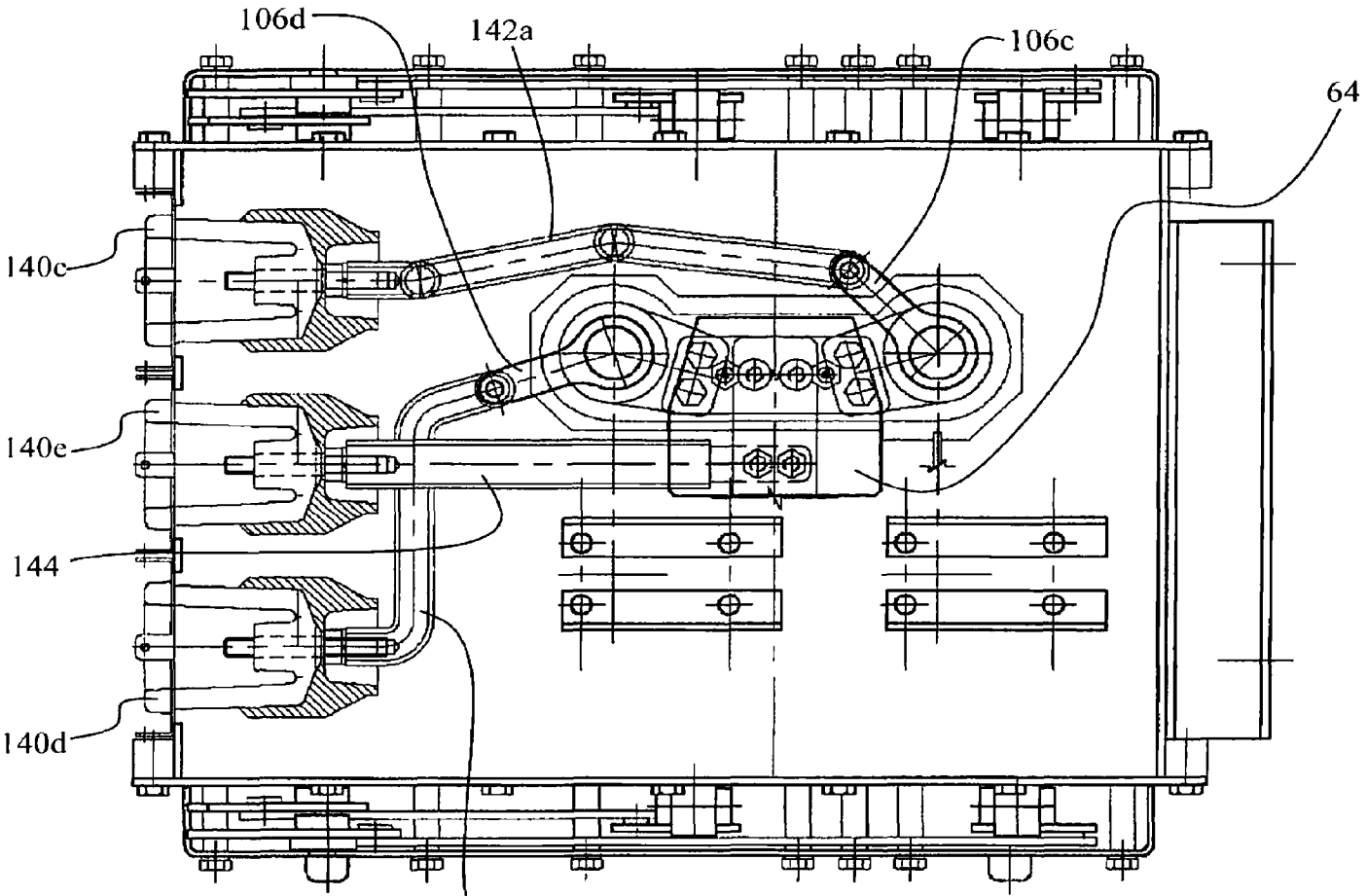
FIG. 26 is a cut-away right side view of the vacuum interrupter switch assembly of FIG. 1, with some components not shown for clarity.
Figure 27:
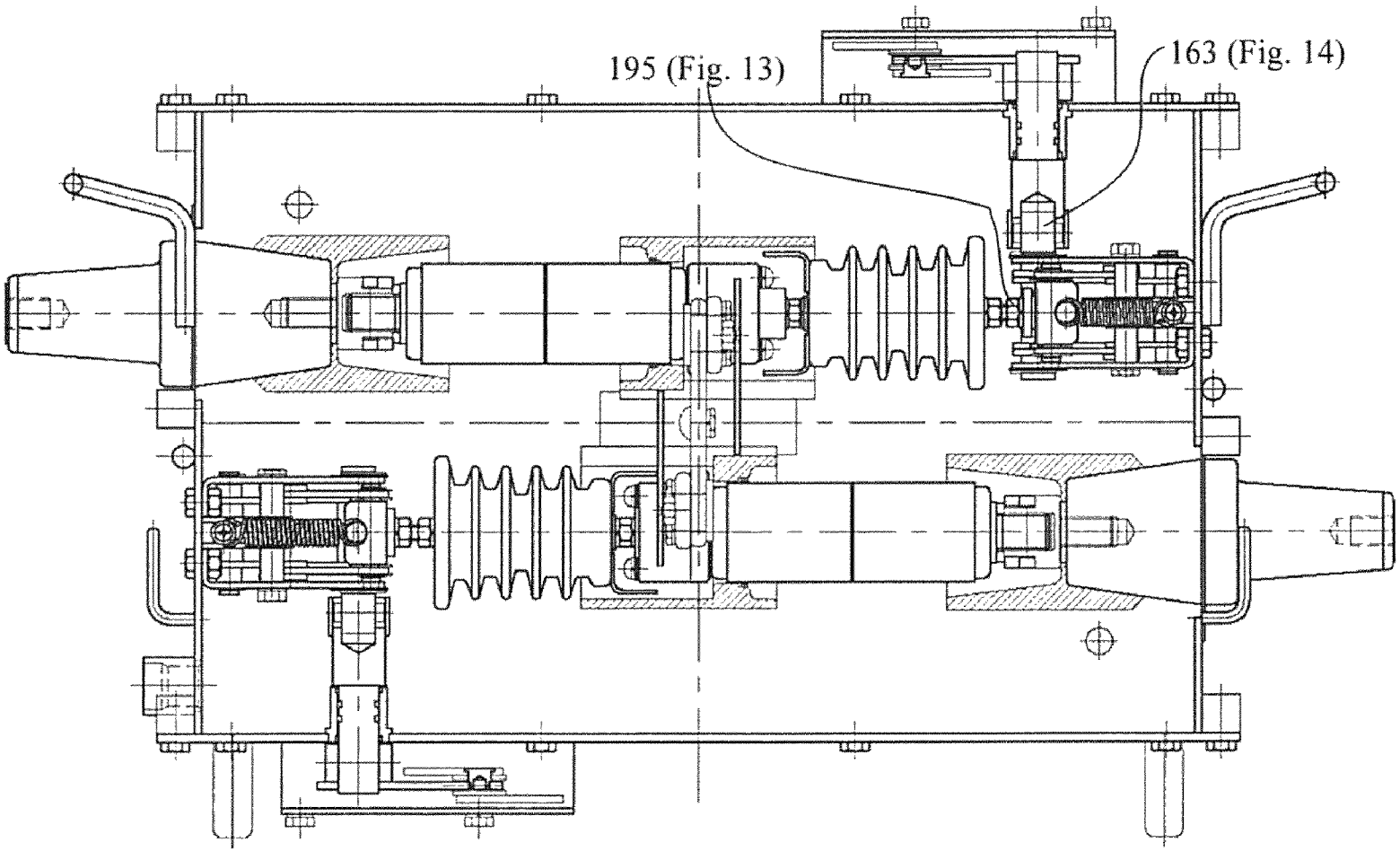
FIG. 27 is a cut-away front view of the vacuum interrupter switch assembly of FIG. 1, with some components not shown for clarity.

Referring to FIGS. 22 and 23, control shaft wells 28*a* and 28*b* are welded to lid 12 at control shaft points 29*a* and 29*b*. Threaded cover spacers 30 are welded to lid 12. Control shaft wells 28*c* and 28*d* are welded to bottom 13 at control shaft points 29*c* and 29*d*. Footing 32 is welded to bottom 13. Threaded cover spacers 30 are welded to bottom 13.

FIGS. 22 and 23 illustrate expanded views of control assembly 40*a* and 40*b* according to the present invention and is generally comprised of a control shaft 41*a*, 41*b*, 41*c*, 41*d*, a control arm 42*a*, 42*b*, 42*c*, 42*d*, either a long arm link 43*a*, 43*b* or a short arm link 44*a*, 44*b*, and handle arm 45*a*, 45*b*, 45*c*, 45*d*. Top control assembly 40*a* is assembled by fastening end 242 of control arm 42*b* to end 244 of short arm link 44*a* with a flathead pin and welded. End 244*a* of short arm link 44*a* is fastened to end 245 of handle arm 45*b* with a flathead pin and welded. End 342 of control arm 42*a* is fastened to end 342*a* of long arm link 43*a* with a flathead pin and welded. End 443 of long arm link 43*a* is fastened to end 445 of handle arm 45*a* with a flathead pin and welded. A pivot spacer 46 is inserted through handle arm 45*a* at pivot point 545, through a washer, into handle arm 45*b* at pivot point 645, through a washer and spacer 48, and into hole 47*a* of lid 12. A plastic spacer 49 is placed around the top end of pivot spacer 46. Bottom control assembly 40*b* is assembled by fastening end 642 of control arm 42*c* to end 45*d* of short arm link 44*b* with a flathead pin and welded. End 45*e* of short arm link 44*b* is fastened to end 644 of handle arm 45*c* with a flathead pin and welded. End 42*e* of control arm 42*d* is fastened to end 443 of long arm link 43*b* with a flathead pin and welded. End 743 of long arm link 43*b* is fastened to end 545 of handle arm 45*d* with a flathead pin and welded. A pivot spacer 46 is inserted through handle arm 45*d* at pivot point 645, through a washer, into handle arm 45*c*, through a washer and spacer 48, and into hole 47*b* of bottom 13. A plastic spacer 49 is placed around the bottom end of pivot spacer 46.

A washer and spacer are placed onto control shafts 41*a*, 41*b*, 41*c*, 41*d*. O-rings 50 are fitted into the grooves 51 on control shafts 41*a*, 41*b*, 41*c*, 41*d*. End of control shaft 41*a* is inserted through control shaft well 28*a* of lid 12, through a spacer and washer and into control arm 42*a*. Hole 341*a* of control shaft 41*a* is aligned with hole 442 of control arm 42*a* and a locking rod 52 is inserted through the holes. End of control shaft 41*b* is inserted through control shaft well 28*b* of lid 12, through a spacer and washer and into control arm 42*b*. Hole 441 of control shaft 41*b* is aligned with hole 442 of control arm 42*b* and a locking rod 52 is inserted through the holes. End of control shaft 41*c* is inserted through control shaft well 28*c* of bottom 13, through a spacer and washer and into control arm 42*c* at pivot opening 542. Hole 641 of control shaft 41*c* is aligned with hole 742 of control arm 42*c* and a locking rod 52 is inserted through the holes. End of control shaft 41*d* is inserted through control shaft well 28*d* of bottom 13, through a spacer and washer and into control arm 42*d* at the pivot opening 842. Hole 741 of control shaft 41*d* is aligned with hole 742 of control arm 42*d* and a locking rod 52 is inserted through the holes.

The top control assembly cover 53*a* is aligned and secured to cover spacers 30 with washers and bolts. The bottom control assembly cover 53*b* is aligned and secured to cover spacers 30 with washers and bolts.

Assembling the Switch

Vacuum Interrupter Switch Assembly

Referring to FIGS. 7, 8, 9 and 24, a vacuum interrupter switch assembly according to the present invention is illustrated. Vacuum interrupter switch assemblies 100*a*, 100*b*, 100*c*, 100*d* generally include a front section comprising of a power bushing 102 with a molded insulation shield 104 and a back section comprising of a threaded stud adapter 130, connector 106 to a bushing well 140, a vacuum interrupter bottle 108, a common bus connector 110 with multilam contacts 112, an insulation collar 114, a push-pull insulator 116, and an operating mechanism assembly.

According to the present invention, Vacuum Interrupter Switch Assemblies 100*a*, 100*b*, 100*c*, 100*d* are assembled into housing 10 as follows:

A cylindrical epoxy insulation shield 104*a*, 104*b*, 104*c*, 104*d* is molded onto power bushings 102*a*, 102*b*, 102*c*, 102*d*, respectively. Power bushing 102*a* with insulation shield 104*a* is inserted into hole 34*a* of tank siding 11*a*. Power bushing 102*b* with insulation shield 104*b* is inserted into hole 34*b* of tank siding 11*a*. Power bushing 102*c* with insulation shield 104*c* is inserted into hole 34*c* of tank siding 11*c*. Power bushing 102*d* with insulation shield 104*d* is inserted into hole 34*d* of tank siding 11*c*. Power bushings 102*a* and 102*b* are welded to tank siding 11*a*. Power bushings 102*c* and 102*d* are welded to tank siding 11*c*.

Each of the cylindrical epoxy insulation shield 141*a*, 141*b*, 141*c*, 141*d* are molded onto bushing well 140*a*, 140*b*, 140*c*, 140*d*. Bushing well 140*a* with insulation shield 141*a* is inserted into hole 35*a* of tank siding 11*b*. Bushing well 140*b* with insulation shield 141*b* is inserted into hole 35*b* of tank siding 11*b*. Bushing well 140*c* with insulation shield 141*c* is inserted into hole 35*c* of tank siding 11*b*. Bushing well 140*d* with insulation shield 141*d* is inserted into hole 35*d* of tank siding 11*b*. Bushing well 140*e* with insulation shield 141*e* is inserted into hole 35*e* of tank siding 11*b*. Bushing wells 140*a*, 140*b*, 140*c*, 140*d* are all welded to tank siding 11*b*.

A threaded stud adapter 130 is screwed into power bushing 102*a*. Bushing well connector 106*a* is installed onto threaded stud adapter 130 with the rectangular portion extending out through hole of insulation shield 104*a*. Nut 128 is screwed onto threaded stud adapter 130 to lock bushing well connector 106*a* into place. Stationary contact 108*f* of vacuum interrupter bottle 108*a* is fitted with a spring washer 127 and screwed into threaded stud adapter 130. An O-ring 122 is temporarily fitted onto vacuum interrupter bottle 108*a*. This procedure is repeated for power bushing 102*b*, 102*c*, 102*d* and vacuum interrupter bottles 108*b*, 108*c*, 108*d*.

Insulation cover 129*a* is temporarily installed over vacuum interrupter bottles 108*a* and 108*b* through the holes.

An insulating plate 118 is placed around moveable contact 108*e* of vacuum interrupter bottle 108*a*. Four insulating cylinders 119 cover the four short studs surrounding moveable contact 108*e*. A short threaded cylindrical contact 121 and a long threaded cylindrical contact 120 is screwed onto moveable contact 108*e* and tightened against one another. A headless bolt 126 is screwed into the internal thread of movable contact 108*e* and tightened with a nut and washer.

An insulating plate 118 is placed around moveable contact 108*e* of the vacuum interrupter bottle 108*b*. Four insulating cylinders 119 cover the four short studs surrounding moveable contact 108*e* of the vacuum interrupter bottle 108*b*. A short threaded cylindrical contact 121 and a long threaded cylindrical contact 120 is screwed onto moveable contact 108*e* and tightened against one another. A headless bolt 126 is screwed into the internal thread of movable contact 108*e* and tightened with a nut and washer.

Common bus connector 110*a*, as illustrated in FIG. 9, has grooves 111 (not shown) inside. Multilam contacts 112 are fitted into the grooves and secured with C-clips 113. The four common bus connectors are substantially identically in structure.

Common bus connector 110*a* is installed onto vacuum interrupter bottle 108*a* by aligning its four holes with the four studs surrounding movable contact 108*e*. An insulating spacer 124 is inserted between common bus connector 110*a* and long threaded cylindrical contact 120. The four holes for insulating spacer 124 are aligned with the four holes in common bus connector 110*a*. Four screws with lock washers are inserted into insulating tubes 123 which are then inserted through the four holes in insulating spacer 124 and common bus connector 110*a* and screwed into the four threaded studs surrounding movable contact 108*e*.

The same procedure also applies to the assembly of common bus connector 110*b*.

Bolt 126 is inserted through a washer, insulating collar 114*a*, and screwed into threaded hole of push-pull insulator 116*a*. Bolt 176 of operating mechanism 150*a* is screwed into threaded hole of push-pull insulator 116*a*.

Bolt 126 is inserted through a washer, insulating collar 114*b*, and screwed into threaded hole of push-pull insulator 116*b*. Bolt 176 of operating mechanism 150*b* is screwed into threaded hole of push-pull insulator 116*b*.

The same procedure also applies to the vacuum interrupter switch assembly 100*c* and 100*d*.

Trapezoidal-shaped bus 61*a* is bolted through holes to common bus connector 110*a* of vacuum interrupter switch assembly 100*a* through holes. Trapezoidal-shaped bus 61*a* is bolted through holes to common bus connector 110*b* of vacuum interrupter switch assembly 100*b* through holes. Trapezoidal-shaped bus 61*b* is bolted through holes to common bus connector 110*c* of vacuum interrupter switch assembly 100*c* through holes. Trapezoidal-shaped bus 61*b* is bolted through holes to common bus connector 110*d* of vacuum interrupter switch assembly 100*d* through holes.

A screw with washers is inserted through hole of insulation cover 129*a*, through a spacer 63, and into a threaded hole of the rectangular-shaped bus 62. A screw with washers is inserted through a hole of the insulation cover 129*b*, a spacer 63, and into threaded hole of rectangular-shaped bus 62.

An O-ring 122 is slid into the groove in between vacuum interrupter bottle 108*b* and insulation cover 129*a*. An O-ring 122 is slid into the groove between vacuum interrupter bottle 108*a* and insulation cover 129*a*. An O-ring 122 is slid into the groove in between vacuum interrupter bottle 108*d* and insulation cover 129*b*. An O-ring 122 is slid into the groove in between vacuum interrupter bottle 108*c* and insulation cover 129*b*.

Vacuum interrupter assembly 100*a* is bolted to tank siding 11*c* at its mounting point and 201*h*, 201*i*, 202*h*, and 202*i* of the operating mechanism 150*a*. Vacuum interrupter assembly 100*b* is bolted to tank siding 11*c* through its mounting point and 201*h*, 201*i*, 202*h*, and 202*i* of operating mechanism 150*b*. Vacuum interrupter assembly 100*c* is bolted to tank siding 11*a* through mounting points 36*c* and 201*h*, 201*i*, 202*h*, and 202*i* of operating mechanism 150*c*. Vacuum interrupter assembly 100*d* is bolted to tank siding 11*a* through its mounting point and 201*h*, 201*i*, 202*h*, and 202*i* of operating mechanism 150*d*.

Referring to FIGS. 5, 6, 25 and 26, one end of connection bus 144 is installed onto bushing well 140*e*. The other end of connection bus 144 is bolted to rectangular-shaped bus 62. One end of connection bus 142*a* is installed onto bushing well 140*a* and the other end is bolted to bushing well connector 106*a* with a copper bolt. A set screw is screwed into a threaded hole of bushing well connector 106*a*. One end of connection bus 143*a* is installed onto bushing well 140*b* and the other end is bolted to bushing well connector 106*b* with a copper bolt. A set screw is screwed into threaded hole of bushing well connector 106*b*. One end of connection bus 143*b* is installed onto bushing well 140*c* and the other end is bolted to bushing well connector 106*c* with a copper bolt. A set screw is screwed into a threaded hole of bushing well connector 106*c*. One end of connection bus 142*b* is installed onto bushing well 140*d* and the other end is bolted to bushing well connector 106*d* with a copper bolt. A set screw is screwed into a threaded hole of bushing well connector 106*d*. All connection buses are covered with insulation material.

An insulating plate 64 is fastened to trapezoidal-shaped bus 61*a* with fitting screws. Another insulating plate 64 is fastened to trapezoidal-shaped bus 61*b* with fitting screws. The fitting screws are covered with a polysiloxane gel.

Hydrocarbon foam is poured into hole 629 and one or more other holes of insulation cover 129*a* and 129*b*, respectively. A circular mold is placed around vacuum interrupter bottle 108*a* and opening 729 of insulation cover 129*a* as well as vacuum interrupter bottle 108*b* and opening 728 of insulation cover 129*a*. Hydrocarbon foam is poured inside the molds. A circular mold is placed around vacuum interrupter bottle 108*c* and the opening 729 in insulation cover 129*b* as well as vacuum interrupter bottle 108*d* and the opening 728 in insulation cover 129*b*. Hydrocarbon foam is poured inside the molds.

A circular mold is placed around vacuum interrupter bottle 108*a* and the opening of insulation shield 104*a* and filled with hydrocarbon foam. A circular mold is placed around vacuum interrupter bottle 108*b* and the opening in insulation shield 104*b* and filled with hydrocarbon foam. A circular mold is placed around vacuum interrupter bottle 108*c* and the opening in insulation shield 104*c* and filled with hydrocarbon foam. A circular mold is placed around vacuum interrupter bottle 108*d* and the opening in insulation shield 104*d* and filled with hydrocarbon foam.

A cylindrical mold is placed over the hole of insulation shield 104*a* and end of connection bus 142*a* and filled with hydrocarbon foam. A cylindrical mold is placed over the hole of insulation shield 104*b* and the end of connection bus 143*a* and filled with hydrocarbon foam. A cylindrical mold is placed over the hole of insulation shield 104*c* and the end of connection bus 143*b* and filled with hydrocarbon foam. A cylindrical mold is placed over the hole of insulation shield 104*d* and the end of connection bus 142*b* and filled with hydrocarbon foam.

A circular mold is placed around the end of connection bus 142*a* and the connection point of bushing well 140*a* and filled with hydrocarbon foam. A circular mold is placed around the end of connection bus 143*a* and the connection point of bushing well 140*b* and filled with hydrocarbon foam. A circular mold is placed around the end of connection bus 143*b* and the connection point of bushing well 140*c* and filled with hydrocarbon foam. A circular mold is placed around the end of connection bus 142*b* and the connection point of bushing well 140*d* and filled with hydrocarbon foam. A circular mold is placed around the end of connection bus 144 and the connection point of bushing well 140*e* and filled with hydrocarbon foam.

Figure 28:
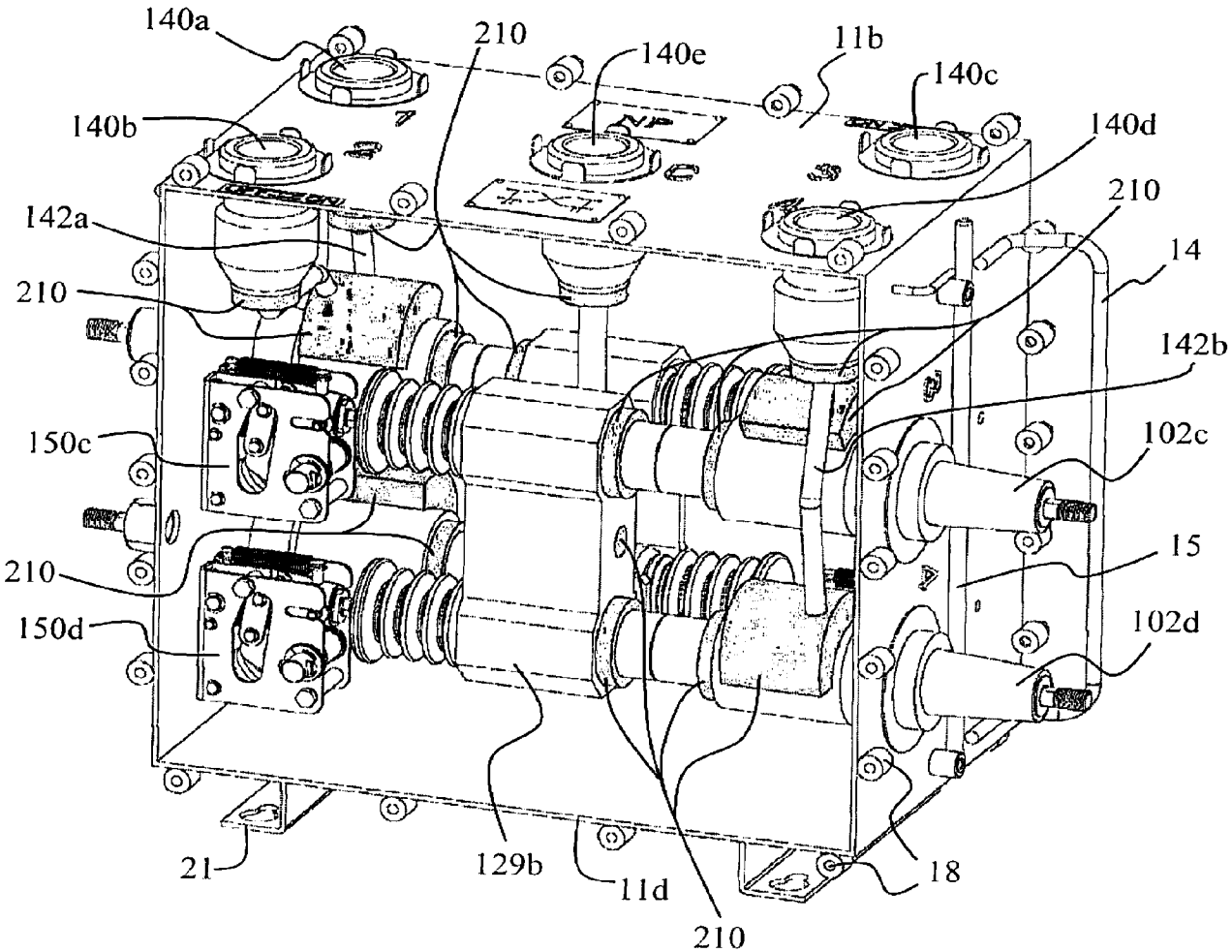
FIG. 28 is a bottom plan view of the vacuum interrupter switch assembly of FIG. 6 illustrating the hydrocarbon foam as shaded for clarity.

All the molds are removed once the hydrocarbon foam has gelled. FIG. 28 illustrates the hydrocarbon foam 210 after it has gelled on the components. For clarity, the hydrocarbon foam 210 is shown shaded in FIG. 28.

The end of control shaft 41*c* and the end of control shaft 41*d* are aligned with and placed onto the end of drive shaft 163 for operating mechanisms 150*c* and 150*d*, respectively. Bottom 13 is bolted to the lower threaded bolting studs 18 of tank sidings 11*a*, 11*b*, 11*c* and 11*d*. Bottom 13 is welded to tank sidings 11*a*, 11*b*, 11*c* and 11*d* and the bolts are welded to the threaded bolting studs 18. The end of control shaft 41*a* and the end of control shaft 41*b* are aligned with and placed onto the end of drive shaft 163 for operating mechanisms 150*a* and 150*b*, respectively. Lid 12 is bolted to the upper threaded bolting studs 18 of tank sidings 11*a*, 11*b*, 11*c* and 11*d*. Lid 12 is welded to tank sidings 11*a*, 11*b*, 11*c* and 11*d* and the bolts are welded to the threaded bolting studs 18.

A standard removable handle 220 is shown in FIG. 1. As an option, unique keyed handles can be made and used.

As an option, gel or insulating oil can be poured into housing assembly 10 before lid 12 is welded on.

As an option, components can be added to housing 10 which can lock the control assemblies in place to prevent improper operation.

Although the present invention and its advantages have been described in detail, it should be understood that various changes, substitutions and alterations can be made herein without departing from the spirit and scope of the invention as will be defined by appended claims.

We claim:

1. A vacuum interrupter switch for a power distribution system comprising:

an enclosure capable of passing through a circular opening having a diameter of approximately 30 inches and substantially free of oil and SF6 gas within its interior;

a first pair of power bushings extending from an upper region of a first side of the enclosure;

a second pair of power bushings extending from a lower region of a second side of the enclosure;

a plurality of vacuum interrupter bottle switches positioned within the enclosure, each of said vacuum interrupter bottle switches having a movable contact and a stationary contact;

a bus positioned within the enclosure and electrically connected to one of said contacts of each of the plurality of vacuum interrupter bottle switches, the stationary and movable contacts of each vacuum interrupter bottle switch being positioned in circuit between the bus and a respective power pushing so that electrical coupling of its contacts electrically couples the power bushing to the bus via the vacuum interrupter bottle switch, and electrical decoupling of its contacts results in no electrical coupling of the power bushing and bus by the vacuum interrupter bottle switch; and a plurality of operating mechanism assemblies coupled to the plurality of vacuum interrupter bottle switches for selectively electrically coupling and decoupling the contacts of selected interrupter bottle switches.

2. The vacuum interrupter switch of claim 1 wherein the first pair of power bushings and the second pair of power bushings extend from opposite sides of the enclosure.

3. The vacuum interrupter switch of claim 1 wherein the plurality of vacuum interrupter bottle switches comprises two pair of vacuum interrupter bottle switches, the two vacuum interrupter bottle switches of each pair extending generally laterally across the interior of the enclosure and generally parallel to each other.

4. The vacuum interrupter switch of claim 1 wherein the bus is electrically connected to the movable contact of each of the plurality of vacuum interrupter bottle switches.

5. The vacuum interrupter switch of claim 1 including a plurality of bushing wells accessible from the enclosure's exterior and respectively coupled electrically to a like plurality of the power bushings.

6. The vacuum interrupter switch of claim 3 wherein the two vacuum interrupter bottle switches of the first pair extend generally laterally across the interior of the enclosure and generally parallel to the second pair of vacuum interrupter bottle switches.

7. A vacuum interrupter switch for a power distribution system comprising:

an enclosure capable of passing through a circular opening having a diameter of approximately 30 inches and substantially free of oil and SF6 gas within its interior;

a plurality of vacuum interrupter bottle switches positioned within the enclosure, each of said vacuum interrupter bottle switches having a movable contact and a stationary contact;

a plurality of connectors located on the exterior of the enclosure, each electrically coupled to a respective contact of a respective vacuum interrupter bottle switch;

a bus positioned within the enclosure and electrically coupled to the other of the contacts of the plurality of vacuum interrupter bottle switches; and a plurality of operating mechanism assemblies coupled to the plurality of vacuum interrupter bottle switches for selectively electrically coupling and decoupling the movable contact and stationary contact of selected ones of the interrupter bottle switches.

8. A vacuum interrupter switch for a power distribution system comprising:

an enclosure capable of passing through a circular opening having a diameter of approximately 30 inches and substantially free of oil and SF6 gas within its interior;

at least one input connector accessible from outside the enclosure;

a plurality of output connectors accessible from outside the enclosure a plurality of vacuum interrupter bottle switches positioned within the enclosure, each of said vacuum interrupter bottle switches having a movable contact and a stationary contact;

a plurality of operating mechanism assemblies coupled to the plurality of vacuum interrupter bottle switches for selectively electrically coupling and decoupling the stationary and movable contacts of selected interrupter bottle switches;

the input connector and output connectors being electrically coupled to the vacuum interrupter bottle switches in such a way that electrical power applied to the input connector is selectively coupled to none, some or all of the output connectors in accordance with the coupling and decoupling of said contacts by the operating mechanisms.

9. The vacuum interrupter switch of claim 8 wherein the vacuum interrupter switch is a single phase 4-way switch whereby input power applied to the input connector is selectively coupled to from zero to three output connectors.

* * * * *